US007933448B2

(12) United States Patent
Downs, III

(10) Patent No.: US 7,933,448 B2
(45) **Date of Patent: *Apr. 26, 2011**

(54) CARD READING SYSTEM EMPLOYING CMOS READER

(75) Inventor: Justin G. Downs, III, Henderson, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 1311 days.

This patent is subject to a terminal disclaimer.

(21) Appl. No.: 11/484,011

(22) Filed: Jul. 7, 2006

(65) Prior Publication Data

US 2007/0018389 A1 Jan. 25, 2007

Related U.S. Application Data

(63) Continuation-in-part of application No. 11/417,894, filed on May 3, 2006, now Pat. No. 7,593,544, which is a continuation-in-part of application No. 11/152,475, filed on Jun. 13, 2005, now Pat. No. 7,769,232.

(51) Int. Cl.

| | |
|---|---|
| ***G06K 9/00*** | (2006.01) |
| ***A63F 1/06*** | (2006.01) |
| ***A63F 1/14*** | (2006.01) |

(52) U.S. Cl. ..... 382/181; 382/100; 273/148 A; 273/148 R

(58) Field of Classification Search ..... 273/149 R, 273/292, 274, 149 P, 309, 303, 148 R, 148 A; 382/100, 181; 463/13, 11, 29, 12, 16; 209/587, 209/547, 939

See application file for complete search history.

(56) References Cited

U.S. PATENT DOCUMENTS

| | | | |
|---|---|---|---|
| 3,222,071 | A | 12/1965 | Lang |
| 3,929,339 | A | 12/1975 | Mattioli |
| 4,494,197 | A | 1/1985 | Troy et al. |
| 4,534,562 | A | 8/1985 | Cuff et al. |
| 4,667,959 | A | 5/1987 | Pfeiffer et al. |
| 4,750,743 | A | 6/1988 | Nicoletti |
| 4,926,327 | A | 5/1990 | Sidley |
| 4,995,615 | A | 2/1991 | Cheng |
| 5,179,517 | A | 1/1993 | Sarbin et al. |
| 5,209,476 | A | 5/1993 | Eiba |
| 5,224,712 | A | 7/1993 | Laughlin et al. |
| 5,257,179 | A | 10/1993 | DeMar |

(Continued)

FOREIGN PATENT DOCUMENTS

| | | |
|---|---|---|
| WO | WO 00/51076 | 8/2000 |

OTHER PUBLICATIONS

U.S. Appl. No. 11/225,393, filed Sep. 2005, Downs, Justin.*

(Continued)

*Primary Examiner* — Sheela C Chawan

(74) *Attorney, Agent, or Firm* — Mark A. Litman & Assoc. P.A.

(57) ABSTRACT

A method and an apparatus determines at least one of rank or suit of a playing card. The apparatus has at least one two-dimensional complementary metal oxide semiconductor imaging system that provides a signal when playing cards are moved over the system. The signal is a series of gray scale values that are converted into binary values. The sensed data is transmitted to a hardware component that identifies at least one of rank and suit to an external data storage device.

22 Claims, 18 Drawing Sheets

U.S. PATENT DOCUMENTS 5,276,312 A 1/1994 McCarthy
5,283,422 A 2/1994 Storch et al.
5,356,145 A 10/1994 Verschoor
5,362,053 A 11/1994 Miller
5,374,061 A 12/1994 Albrecht
5,470,079 A 11/1995 LeStrange et al.
5,586,766 A 12/1996 Forte et al.
5,586,936 A 12/1996 Bennett et al.
5,605,334 A 2/1997 McCrea, Jr.
5,613,912 A 3/1997 Slater
5,655,961 A 8/1997 Acres et al.
5,669,816 A 9/1997 Garczynski et al.
5,681,039 A 10/1997 Miller
5,722,893 A 3/1998 Hill et al.
5,735,525 A 4/1998 McCrea, Jr.
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,911,626 A 6/1999 McCrea, Jr.
5,919,090 A 7/1999 Mothwurf
5,941,769 A 8/1999 Order
5,989,122 A 11/1999 Roblejo
6,039,650 A 3/2000 Hill
6,071,190 A 6/2000 Weiss et al.
6,093,103 A 7/2000 McCrea, Jr.
6,117,012 A 9/2000 McCrea, Jr.
6,126,166 A 10/2000 Lorson et al.
6,165,069 A 12/2000 Sines et al.
6,217,447 B1 4/2001 Lofink et al.
6,250,632 B1 * 6/2001 Albrecht ..... 273/149 R
6,267,248 B1 7/2001 Johnson et al.
6,267,671 B1 7/2001 Hogan
6,270,404 B2 8/2001 Sines et al.
6,293,864 B1 9/2001 Romero
6,299,536 B1 * 10/2001 Hill ..... 463/47
6,313,871 B1 11/2001 Schubert
6,346,044 B1 2/2002 McCrea, Jr.
6,361,044 B1 3/2002 Block et al.
6,403,908 B2 6/2002 Stardust et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,582,301 B2 6/2003 Hill
6,582,302 B2 6/2003 Romero
6,585,586 B1 7/2003 Romero
6,595,857 B2 7/2003 Soltys et al.
6,616,535 B1 9/2003 Nishizaki et al.
6,622,185 B1 9/2003 Johnson et al.
6,629,889 B2 10/2003 Mothwurf
6,629,894 B1 10/2003 Purton
6,638,161 B2 10/2003 Soltys et al.
6,645,068 B1 11/2003 Kelly et al.
6,645,077 B2 11/2003 Rowe
6,652,379 B2 11/2003 Soltys et al.
6,663,490 B2 12/2003 Soltys et al.
6,666,768 B1 12/2003 Akers
6,685,567 B2 2/2004 Cockerille et al.
6,685,568 B2 2/2004 Soltys et al.
6,688,979 B2 2/2004 Soltys et al.
6,712,696 B2 3/2004 Soltys et al.
6,719,634 B2 4/2004 Mishina et al.
6,746,333 B1 6/2004 Onda et al.
6,758,751 B2 7/2004 Soltys et al.
6,758,757 B2 7/2004 Luciano, Jr. et al.
6,804,763 B1 10/2004 Stockdale et al.
7,264,241 B2 * 9/2007 Schubert et al. ..... 273/149 R
7,593,544 B2 * 9/2009 Downs et al. ..... 382/100
2001/0036231 A1 11/2001 Easwar et al.
2001/0036866 A1 11/2001 Stockdale et al.
2002/0107067 A1 8/2002 McGlone et al.
2002/0187830 A1 12/2002 Stockdale et al.
2003/0087694 A1 5/2003 Storch
2004/0116179 A1 6/2004 Nicely et al.
2005/0119048 A1 * 6/2005 Soltys et al. ..... 463/29
2005/0242500 A1 11/2005 Downs, III
2006/0027970 A1 * 2/2006 Kyrychenko ..... 273/309

OTHER PUBLICATIONS

U.S. Appl. No. 11/152,475, filed Jun. 2005, Downs, Justin.*
U.S. Appl. No. 11/488,903, filed Jul. 2006, Downs, Justin.*
Tracking the Tables, by Jack Bularsky, Casino Journal, May 2004, vol. 17, No. 5, pp. 44-47.
Litwiller, Dave, CCD vs. CMOS: Facts and Fiction, reprinted from the Jan. 2001 issue of Photonics Spectra, Laurin Publising Co. Inc. (4 pgs).

* cited by examiner

Column Sums and Split Line

CARD READING SYSTEM EMPLOYING CMOS READER

RELATED APPLICATION DATA

This application is a continuation-in-part of U.S. patent application Ser. No. 11/417,894, filed May 3, 2006, now U.S. Pat. No. 7,593,544, which is a continuation-in-part of U.S. patent application Ser. No. 11/152,475, filed Jun. 13, 2005, now U.S. Pat. No. 7,769,232.

BACKGROUND OF THE INVENTION

1. Field of the Invention

The present invention relates to the field of gaming, the play of games dealt out of a card-reading shoe, and systems for reading the rank and or suit of cards.

2. Background of the Art

The content of U.S. patent application Ser. No. 11/417,894 filed May 3, 2006, and U.S. patent application Ser. No. 11/152,475 filed Jun. 13, 2005, is herein incorporated by reference in their entireties.

Cards are ordinarily provided to players in casino table card games either from a deck held in the dealer's hands, from a shuffler, or from a dealing shoe. The original dealing racks were little more than trays that supported the deck(s) of cards after shuffling and allowed the dealer to remove the front card (with its back facing the table to hide the rank and/or suit of the card) and deliver it to a player. Over the years, many alternative card delivery devices have been introduced.

U.S. Pat. No. 4,667,959 (PFEIFFER) describes a card apparatus having a card hopper adapted to hold from one to at least 104 cards, a card carousel having multiple slots for holding cards, an injector for sequentially loading cards from the hopper into the carousel, output ports, ejectors for delivering cards from the carousel to any one of the output ports, and a control board and sensors, all in a housing. The apparatus is capable of communicating with selectors which are adjustable for making card selections.

U.S. Pat. No. 4,750,743 (NICOLETTI) describes the use of a mechanical card dispensing means to advance cards at least part way out of a shoe. The described invention is for a dispenser for playing cards comprising: a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card advance means contacting the trailing card and adapted to urge the stacked cards down the inclined floor; card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

U.S. Pat. No. 5,681,039 (MILLER) describes a "no peek" device for speeding the pace of a game of blackjack. The device is comprised of a housing having a top surface. A card reader for reading playing card markings is located within the housing. An indicator cooperating with the card reader is provided to inform the dealer if his down card is of a desired value. There is also disclosed herein a method for increasing the speed of play in an organized game of blackjack. The device indicates the presence of an ace or ten as the hole card in the dealers Blackjack hand.

U.S. Pat. No. 5,779,546 (MEISSNER) describes a method and apparatus to enable a game to be played based upon a plurality of cards. An automated dealing shoe dispenses each of the cards and recognizes the rank and/or suit of each of the cards as each of the cards is dispensed. Electronic player controls are also included. The controls enable a player to enter a bet, request that a card be dispensed or not dispensed, and converts each bet into a win or a loss based upon the cards which are dispensed by the automated dealing shoe.

U.S. Pat. No. 5,989,122 (ROBLEJO) relates to an apparatus for randomizing and verifying sets of playing cards.

The patent describes a process of playing a card game comprising providing such an apparatus, feeding unverified sets of playing cards to the apparatus, and recovering verified true sets of cards from the apparatus.

U.S. Pat. Nos. 5,605,334; 6,093,103 and 6,117,012 (McCREA) disclose apparatus for use in a security system for card games. The secure game table system comprises: a shoe for holding each card from said at least one deck before being dealt by said dealer in said hand, said shoe having a detector for reading at least the value and the suit of said each card.

U.S. Pat. No. 6,250,632 (ALBRECHT) describes an apparatus and method for sorting cards into a predetermined sequence. One embodiment provides a deck holding area in which cards are held for presenting a card to a reading head for reading the characters on the face of the card. The apparatus also has a tray having a sequence of slots and a card moving mechanism for moving the presented card from the deck holding area into one of the slots. The tray is connected to a tray positioning mechanism for selectively positioning the tray to receive a card in one of the slots from the card moving mechanism. A controller is connected to the read head, the card moving mechanism, and the tray positioning mechanism. The controller controls the reading of each of the cards by the read head and identifies the value of each card read, and also controls the card moving mechanism to move each of the cards to a slot of the tray positioned by the tray positioning mechanism according to the predetermined sequence of values.

U.S. Pat. No. 6,267,248 (JOHNSON) describes a collation and/or sorting apparatus for groups of playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines (according to a preprogrammed routine) whether cards identified by sensor (15) are collated in the magazine (20) as an ordered deck of cards or a randomly ordered or "shuffled" deck. This device reads card rank and or suit.

U.S. Pat. No. 6,403,908 (STARDUST) describes an automated method and apparatus for sequencing and/or inspecting decks of playing cards. The method and apparatus utilizes pattern recognition technology or other image comparison technology to compare one or more images of a card with memory containing known good images of a complete deck of playing cards to identify each card as it passes through the apparatus.

U.S. Pat. No. 6,217,447 (LOFINK) describes a method and system for generating displays related to the play of Baccarat. Cards dealt to each of the Banker's and Player's hands are identified as by scanning and data signals are generated. The card identification data signals are processed to determine the outcome of the hand. Displays in various formats to be used by players are created from the processed identification signals including the cards of the hand played, historical records of outcomes and the like. The display can also show bettors expected outcomes and historical bests. Players can refer to the display in making betting decisions.

The scanner 32 is of the type which optically scans the card face and generates data signals corresponding to the optical characteristics of the face of the card. As but an example, digital camera means can be used to generate data signals, broken in picture elements, i.e. pixels, the signal strength at the locations of the individual pixels collectively corresponding to the actual appearance of the face."

U.S. Pat. Nos. 5,669,816 and 5,772,505 (GARCZYNSKI) describes a "no peek" dual card scanning module that announces when the symbols of a face-up standard playing card and a face-down standard playing card achieve a desired combination (a blackjack). The module has a scanner system that illuminates and scans at least a portion of a symbol of the face-up standard playing card and at least a portion of a symbol of the face-down standard playing card and stores the results thereof in a first and second array device, respectively. When in this position, the symbol portions of the face-up and the face-down standard playing cards can be scanned by the array devices to generate respective scanning results. The module compares the scanning results with a memory storing a plurality of references representing respective symbols of the standard playing cards to determine if the cards have achieved the desired combination.

U.S. Pat. Nos. 6,582,301; 6,299,536; 6,039,650; and 5,722,893 (HILL) describe a dealing shoe that has a card scanner which scans indicia on a playing card as the card moves along and out of a chute by manual direction by the dealer in the normal fashion. The scanner can be one of several different types of devices which will sense each card as it is moved downwardly and out of the shoe. A feed forward neural-network is trained, using error back-propagation to recognize all possible card suits and card values sensed by the scanner.

U.S. Pat. No. 6,126,166 (LORSON) describes a system for monitoring play of a card game between a dealer and one or more players at a playing table, comprising: (a) a card-dispensing shoe comprising one or more active card-recognition sensors (for reading rank and or suit) positioned to generate signals corresponding to transitions between substantially light background and dark pip areas as standard playing cards are dispensed from the card-dispensing shoe, without generating a bit-mapped image of each dispensed standard playing card; and (b) a signal processing subsystem. The subsystem may be adapted to: receive the transition signals generated by the active card-recognition sensors; determine, in real time and based on the transition signals, playing-card values for the dispensed standard playing cards; and determine, in real time, a current table statistical advantage/disadvantage relative to the players for playing cards remaining in the card-dispensing shoe.

U.S. Pat. No. 5,941,769 (ORDER) describes a device for use in table games of chance with playing cards and gaming chips (jettons), in particular the game of "Black Jack." An automatic apparatus is provided which will register and evaluate all phases of the run of the game. This is achieved by providing a card shoe with an integrated device for recognition of the value (rank and or suit) of the drawn cards (3') (optical recognition device and mirroring into a CCD-image converter); photodiodes (52) arranged under the table cloth (51) in order to register separately the casino light passing through each area (53, 54) for placing the gaming chips (41) and areas (55, 56) for placing the playing cards (3) in dependence of the arrangement or movement of the jettons and playing cards on the mentioned areas; a device for automatic recognition of each bet (scanner to register the color of the jettons, or a RFID-system comprising a S/R station and jettons with integrated transponder); an EDP program created in accordance with the gaming rules to evaluate and store all data transmitted from the functional devices to the computer; and a monitor to display the run of the game and players' wins.

U.S. Pat. No. 6,460,848 (SOLTYS)—MindPlay LLC U.S. Patent describes a system that automatically monitors playing and wagering of a blackjack game, including the gaming habits of players and the performance of employees. A card deck reader automatically reads an edge symbol from each card in a deck of cards before a first one of the cards is removed. The symbol identifies a respective rank and suit of the card.

There are numerous other MindPlay LLC patents, including at this time U.S. Pat. Nos. 6,712,696; 6,688,979; 6,685,568; 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; and 6,517,435.

The disclosure in some of the later Soltys Patents (especially those derived from Published U.S. Patent Applications Nos. 20030096645; 20030087696; and 20020155869 includes a disclosure of a CMOS card reading function. "The play tracking subsystem 56 is shown in FIG. 10 as including a playing surface imager 152, positioned within the enclosure formed by the side wall 120 of the chip tray 36 to provide an approximately 180 (degree) view of the playing surface 26 in front of the chip tray 36. In this embodiment, the playing surface imager 152 consists of nine area CMOS color sensors . . . , although the playing surface imager 152 can employ a lesser or greater number of sensors. Each of the CMOS color sensors . . . have a respective field-of-view 154. The playing surface imager 152 can employ other image capture devices, although area CMOS color sensors . . . are particular suitable for imaging the chips 38 and cards of the deck 18 on the playing surface 26 of the gaming table 10, such as wager chips 22 and played cards 30-34 . . . . The CMOS color sensors . . . provide a low angle view of the playing surface 26 (approximately 15 (degrees)) . . . " US20030096645, page 5, paragraph [0078].

U.S. Published Patent Application No. 20040116179 (Wagerworks, Inc.) describes a game system in which method steps can also be performed by, and apparatus of the invention can be implemented as, special purpose logic circuitry, e.g., an FPGA (field programmable gate array) or an ASIC (application-specific integrated circuit).

WO 00/51076 and U.S. Pat. No. 6,629,894 (DOLPHIN ADVANCED TECHNOLOGIES PTY. LTD.) disclose a card deck inspection device that includes a first loading area adapted to receive one or more decks of playing cards. A drive roller is located adjacent the loading area and positioned to impinge on a lowermost card if a card were present in the loading area. The loading area has an exit through which cards are urged, one at a time, by a feed roller. A transport path extends from the loading area exit to a card accumulation area. The transport path is further defined by two pairs of transport rollers, one roller of each pair above the transport path and one roller of each pair below the transport path. A camera is located between the two pairs of transport rollers, and a processor governs the operation of a digital camera and the rollers. A printer produces a record of the device's operation based on an output of the processor, and a portion of the transport path is illuminated by one or more blue LEDs.

Published U.S. Patent Application No. 20010036231 (Easkar) discloses an in-camera two-stage compression implementation that reduces the latency between snapshots to a fraction of that otherwise required by other systems that either process complete compression following each snapshot or that incorporate heavy, bulky, and expensive RAM hardware capable of maintaining several raw luminosity records (unprocessed file containing a digital image). In the first stage of compression the raw luminosity record is quickly, yet partially, compressed to available RAM buffer space to allow a user to expeditiously capture a succeeding image. When the higher-priority processes, the user shooting pictures, and stage one compression subside, a second stage compression, which is slower but more effective, decompresses the earlier partially-compressed images, and re-compresses them for saving in flash memory until they are distributed to a remote platform to be finally converted to the JPEG2000 format.

Each of the references identified in the Background of the Art and the remainder of the specification, including the Related Application Data are incorporated herein by reference in their entirety as part of the enabling disclosure for such elements as apparatus, methods, hardware and software.

SUMMARY OF THE INVENTION

A card reading apparatus for the determination of at least one of rank or suit of a playing card is disclosed. The apparatus comprises at least one complementary two-dimensional metal oxide semiconductor imaging system which provides a signal when playing cards are moved in close proximity to the sensor. The apparatus includes a hardware component that receives the signal being communicated by the imaging system. The hardware component identifies at least one of rank and suit from the signal and transmits data indicating the at least one of rank or suit so that the at least one of rank or suit can be identified in real time or subsequently. The real time information can be sent to a local processor for storage and/or data analysis or to a network database. A preferred hardware component is a FPGA logic circuit or an ASIC circuit. A preferred imaging system is a 2-Dimensional active CMOS imager.

The apparatus of the present invention includes an imager that images an area of a card containing conventional rank and or suit markings on playing cards in at least the region where suit and rank symbols are provided on the playing card. Gray scale data is generated from the sensor. This data may be transformed into binary data, and the binary data may be further processed into data representing at least one of a suit or rank of the playing card.

The gray scale data is preferably a series of integers within the range of gray scale resolution of the imager. Although other imagers can be used, one preferred type of imager is a two-dimensional active CMOS imaging array. The signal from the CMOS imaging array or other suitable sensor is received by a FPGA or ASIC and the data is analyzed to determine at least one of a suit or rank of the playing card imaged. The FPGA or ASIC circuit preferably outputs rank and suit data to either a local computer or via a network connection to a network database. One unique aspect to the FPGA control logic is that signals received and converted by the control logic are compared with signals of known rank and suit of a playing card.

The present invention can be characterized as a method for identifying suit and rank of playing cards, of the type with no special markings. The method includes the step of passing symbols on a playing card past a two-dimensional complementary metal oxide semiconductor imager. The image may be sensed while the card is moving, or when the card is stationary. Signals are provided from the imager, such as when a triggering event such as the presence of a card is sensed. The data is collected and then it is parsed down into only card rank area and card suit area information, the balance of the scanned data being ignored. In other forms of the invention, only the rank and suit areas of the card are scanned. The rank and suit of the card is identified by comparing acquired data to stored reference data. In one example of the invention, the identification of suit or rank is based on a signal representing a series of gray scale values within a range of gray scale values. In a preferred form of the invention, the gray scale values are converted to binary values either in the CMOS sensor, within the FPGA or in a microprocessor associated with the FPGA prior to comparing the acquired data to stored data.

Stored values are typically in the form of vector sets representing matrices, one matrix for each of the four unique card suits and one for each of the thirteen unique card ranks in a deck of cards. These reference vector sets are referred to as templates. The "rank" templates are compared to the acquired rank data sets and the "suit" templates are compared to the acquired suit data sets, each by means of a cross-correlation algorithm. The cross-correlation values of two independent matrices A and B are defined as:

$$\frac{\sum\sum A*B}{\sqrt{\sum\sum A*A*-\sum\sum B*B}}$$

Where A is the acquired vector set and B is a reference vector set. Although other hardware devices can be used to accomplish the correlation of matrices, a FPGA is a particularly useful hardware component to perform this function. Once the rank and suit is determined, an output signal from the FPGA can forward rank and/or suit information via a network connection, for example to a distal database on a network, or to a local computer for storage and further use. The FPGA itself may be in communication with a microprocessor with associated memory. Information such as the reference rank and suit templates may be stored in this associated memory.

Information that is forwarded via the FPGA logic circuit to a database may be mined by a separate processor, or by a local processor. A thin client interface can be used to access and manipulate data collected by the card rank and suit reading device of the present invention. Examples of thin client user interfaces include PC's, blackberries, PDA's, cell phones and the like.

In some instances, the cross-correlation analysis is not sufficiently accurate to distinguish between the various stored symbols. When the identification is indeterminate, an error correction function is applied to templates of at least one of rank and suit images to make a more accurate identification. One exemplary error correction function is defined as the following equation:

$$\Sigma\Sigma A*B-\Sigma\Sigma A'*B$$

This error function detects unmatched areas between signals from the imager and predetermined signals, rather than detecting matched areas.

Signals from the imager of the present invention are preferably in the form of a vector set. A preferred sensor is a 2-D CMOS array and a more preferred form of this array is an active 2-D CMOS array.

After the determination of suit and/or rank is made, the data may be sent to a game control processor for evaluation of game results. This processor can be a processor assigned to a particular table, to a pit where the table is located or to a casino network processor.

The sensing system of the present invention can be advantageously incorporated into a number of card handling devices, including a shuffler, a deck verification device, a sorter or a card delivery shoe. One type of shoe is a mechanized playing card delivery shoe.

According to one aspect of the invention, the playing card delivery shoe is for use in the play of the casino table card game of at least one of baccarat or blackjack. The shoe includes a) an area for receiving a first set of playing cards useful in the play of the casino table card game of at least one of blackjack or baccarat; b) first card mover that moves playing cards from the first set to a playing card staging area wherein at least one playing card is staged in an order by which playing cards are removed from the first set of cards and moved to the playing card staging area; c) second playing card mover that moves playing cards from the playing card staging area to a delivery area wherein playing cards removed from the staging area to the delivery shoe are moved in the same order by which playing cards were removed from the first set of playing cards and moved to the playing card staging area; and d) a playing card reading sensor that reads at least one playing card value of each playing card separately, the playing card reading sensor comprising a CMOS sensor and FPGA logic circuit. There exists in the system a direct or indirect communication link between the playing card reading sensors and the FPGA logic circuit, wherein the FPGA logic circuit determines rank and suit of cards. The system may further include a processor which analyzes the data according to rules of play of the game of at least one of blackjack or baccarat and determines results of play for a round of play based upon said data.

The sensing system of the present invention may also be incorporated into a playing card shoe without mechanical card moving elements. Such a dealing shoe is capable of reading cards and includes: a cavity for receiving a group of shuffled cards; a lower surface of the cavity; a front end and a back end; wherein the lower surface declines towards the front end where cards are removed; a weighted wedge that contacts a surface of a card nearest the back end and rests on the declining lower surface, urging cards towards the front end; a card removal opening in the front end; a card reading sensing system comprising a CMOS sensing array proximate the front end and a FPGA logic device for receiving signals from the CMOS sensing array and determining rank and suit of each sensed card.

The sensing system of the present invention may be incorporated into an automatic card shuffler, the card shuffler having card rank and or suit reading capability including at least: a housing; a card input tray; a shuffling mechanism; a card output tray, and a card sensor within the housing comprising a CMOS card sensor and FPGA logic device for receiving signals from the CMOS sensor when a card is read and determining rank and suit from the sensed signals.

DETAILED DESCRIPTION OF THE INVENTION

Figure 1:
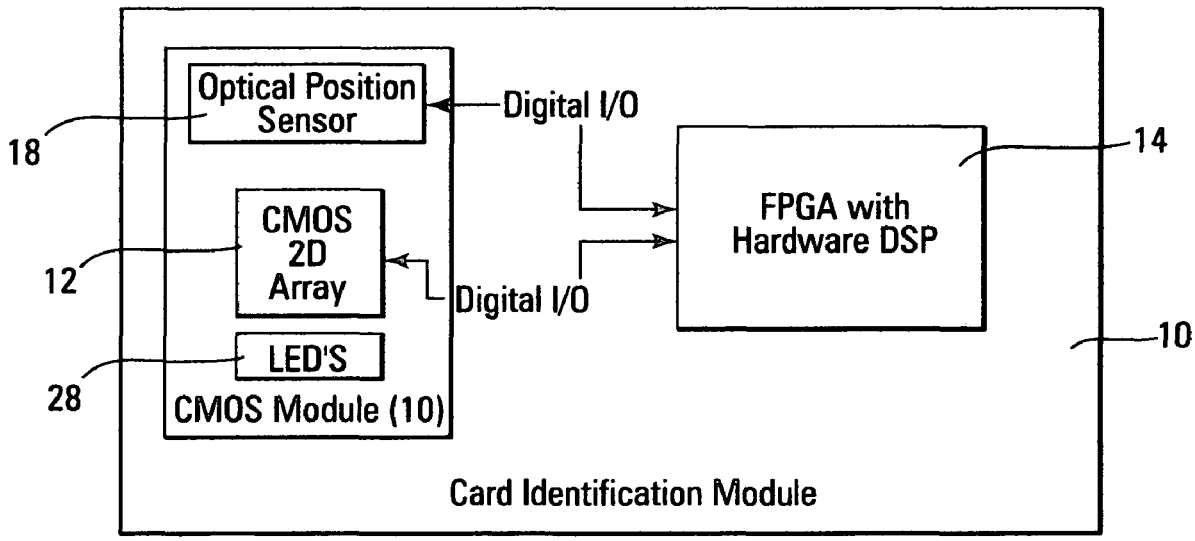
FIG. 1 is a schematic diagram of a CMOS two-dimensional Card Identification Module.

An improved system for obtaining information on the rank and suit of cards from standard symbols on playing cards focuses on using:

1) small 2-Dimensional image arrays, particularly CMOS sensors;
2) black and white imaging;
3) converting sensor output to binary values so that more sophisticated shading or optical density readings are obviated;
4) Simple template matching may be used, rather than elaborate image extraction techniques.

One previously preferred, and still useful construction for determining rank and suit on cards uses a contact image sensor (CIS) module or line scan array, as described in pending U.S. patent application Ser. No. 11/152,475, filed Jun. 13, 2005. The content of this disclosure is hereby incorporated by reference in its entirety. The CIS array is used to output 1-dimensional line scan data as a vector, and hardware (such as ASIC or preferably an FPGA) is used to transform the vectors to information signals conveying rank and suit information. The binary data collected by the CIS module is not image data (not 2-dimensional). The acquired vector data (or a signal vector) is compared with known (high quality) reference vectors, and the known reference vector with the highest correlation to the acquired signal vector identifies suit or rank and the hardware component can initiate sending of rank and suit information to a data storage medium or processor.

The present CMOS reading system with FPGA logic control circuit can be incorporated into a card handling device such as a baccarat shoe. The shoe is then able to read and report the rank and suit of each playing card that is dealt, determine the winner during the dealing process and record each card, the reconstructed hands and the outcome of the game (Player/Banker/Tie). Systems of the present invention may include a display that is able to display multiple rounds of play and the result of each round. It can display the result by a player-viewable reader board and send all of the game information to a casino database through a network.

Two structural elements of note that comprise some of the technical advances of this system compared to known systems are: 1) replacing a known expensive CCD camera with a less expensive and highly reliable and easily replaceable CMOS sensor array, 2) replacing an external PC with a card identification (ID) module that utilizes a Field Programmable Gated Array (FPGA) technology or other comparable hardware to identify playing cards (by suit, rank and/or deck verification) and a microprocessor. The proposed design reduces the cost and the complexity of known systems and at the same time, increases security and reliability.

The proposed device can be used as a stand-alone image reading device for playing cards and it can replace camera/imaging/processor systems presently used by in delivery shoes, discard racks, deck checking and sorting devices and shufflers with reading capacity.

Additional features proposed enable reading of different card images without precisely aligning the CMOS array or elements with each card (by using column sums of selected indices of signals, and the location of symbols). Communication may be through a digital output port or other known means.

For example, the output of an exemplary CMOS black and white camera can be classified as having a series of gray scale output values between 255 (white) and 0 (black) or any other linear or exponential scale. The CMOS sensor provides a representation of the 2-dimensional space by providing a continuous series of Vectors derived from a single card that are correlated with known reference vectors through the hardware (e.g., ASIC or FPGA) and the closest correlation results in an identification of the suit and rank of the card.

The present invention is a card reading apparatus that is capable of reading card rank, suit or both rank and suit. The system reads standard cards that do not have special markings. The apparatus includes at least one complementary metal oxide semiconductor (CMOS). The sensor generates signals when a playing card is moved over the sensor. Although the sensor is capable of sensing stationary cards, a preferred sensing occurs while the card is in motion.

The invention also includes the use of hardware component, capable of receiving signals from the sensor, and identifying rank and/or suit. The hardware component transmits identified the rank and/or suit symbol in real-time to an external device such as a processor.

The sensor is preferably a black and white CMOS sensor, and data from the sensor comprises grey scale data from the scanned image. The gray scale data is converted to binary data either in the hardware component or on the CMOS sensor board.

The hardware component of the present invention includes an FPGA, ASIC or other equivalent device capable of being configured to identify rank and/or suit of cards. Also included is a microprocessor with associated memory. The FPGA receives the reference vectors on power up from the associated memory and uses the reference vectors to determine rank and suit identification.

One application of the CMOS sensing system of the present invention is in combination with a mechanized dealing shoe. The sensing system in its broadest aspect includes a CMOS sensing array and a FPGA logic circuit that is capable of converting signals from the CMOS sensor into a vector array and compare the vector array to stored vectors to determine rank and or suit of cards.

The present dealing shoe is implemented specifically for use in the play of casino table games, and especially blackjack (or Twenty-One), and Baccarat. The card reading system of the present invention provides card rank and or suit reading without greatly increasing the space on the casino table top as compared to a standard dealing shoe. The mechanized shoe provides cards securely to a delivery area and can read the cards in one or more various positions within the shoe, including, but not exclusively a) as they are withdrawn, b) before they are actually nested in the card delivery area, c) when they are first nested in the card delivery area and d) in an area between the card delivery and card withdrawal areas. The card reading information is either stored locally or transferred to a central computer for storage and/or evaluation. The cards preferably may be, but are not required to be mechanically transferred from a point of entry into the dealing shoe to the card delivery area, with a buffer area in the path where at least some cards are actually held for a period of time. With the improved methodology of reading provided with the present technology, advantages are provided even in completely manually delivered shoes with the reading technology described herein. In the mechanically driven mode, the cards are preferably read in the buffer area, before they are delivered into the card delivery area.

The output from the CMOS sensor may be processed by an FPGA, an ASIC circuit or other equivalent device. An ASIC is Application-Specific Integrated Circuit, a chip designed for a particular application. ASICs are built by connecting existing circuit building blocks in new ways. Since the building blocks already exist in a library, it is much easier to produce a new ASIC than to design a new chip from scratch.

FPGAs are field programmable gated arrays, which are a type of logic chip that can be configured after manufacturing. An FPGA is similar to a programmable logic device (PLD), but whereas PLDs are generally limited to hundreds of gates, FPGAs support thousands of gates. They are especially popular for prototyping integrated circuit designs. Once the design is set, hardwired chips may be produced at a lower cost. Once a FPGA is programmed, the device behaves as a hard wired circuit. FPGA's do not execute code, and this is an important point in distinguishing FPGA functionality from that of a processor.

CMOS Module

In the technology described and enabled herein, it is desirable to provide a two-dimensional CMOS sensor 12 as part of an imaging module 10 as sown in FIG. 1. The module may comprise either two related units (the CMOS sensor itself 12 and a separate FPGA logic circuit 14 which receives and acts upon raw signals or data from the CMOS camera), or an integrated system with the CMOS camera and logic/intelligence/functions of the FPGA combined into the single unit. An optical position sensor 18 may or may not be provided to initiate the capture of data from the sensor array 12, because the array 12 is typically always sensing. The CMOS module 10 may also include one or more LED light sources (not shown) to illuminate areas being scanned.

The CMOS Module of the present invention should have the following design attributes:

1. Speed—Should be able to provide identification function (ID) in less than 300 milliseconds.
2. Modular design—Should be able to provide a modular design that is not dependent on specific installation positions or specific design/composition of the sensor.
   a. The imaging system should be capable of integration into a number of products, such as a card shoe, a card shuffler, a hand-forming card shuffler, a discard rack, a "no peek" device, a deck verification device, a collator and as a stand-alone table-top card reader, for example.
   b. The FPGA (or ASIC) design should be capable of processing signals from multiple similar sensor types such as CMOS cameras.
3. Communications—Preferably the system should operate with industrial standard systems such as TCP/IP enabled, SPI communication channel, RS232 communication channel, or via USB port.
   a. The communication system should be able to be in information contact with the processor of a card handling device or external computer.
   b. The communication system should be able to work within a modular table game data collection system (Intelligent Table System, comprising functional casino card table elements such as shuffler, dealing shoe, discard tray, card readers, wagering chip readers, game control computers, table computers, central computers, pit computers and a system network, with finite state machine implementation.)
4. Size—must fit into a card handling device such as a shoe or shuffler, with a preferred overall maximum scale of dimensions of about (80×150×20 mm), such as 60×120 mm, with its height under 17 mm
   a. Current shoe designs have room for a full board with sensor.
   b. Shuffle Master, Inc.'s (SMI's) MD-2 shuffler presently has only room for a CMOS sensor without support processing hardware. Support processing hardware may be located remotely but within shuffler housing.
5. Versatility—module must be capable of working in shoe, in a deck verification device, in a discard rack and in various commercial shufflers and particularly SMI's MD-2 shuffler.
6. Cost—Should be under $400.00 (2005 US dollars), preferably under $250.
7. Simplicity—the CMOS sensor is preferably an inexpensive black and white sensor.

One way of easily accommodating the above-described characteristics is to provide a two piece design. In this two-part design, the FPGA (Field Programmable Gated Array) module that provides processing and communication support for any sensor type is provided. The FPGA module incorporates a power supply, communications capability, hardware algorithm implementation ability and data storage capability. It is connected to a sensor module, e.g., via physical connections such as a 20 pin cable.

In this example of the invention, the above design characteristics are met as follows:

1. Speed—identification algorithm implemented in hardware within FPGA allows under 300 millisecond identification speed.
2. Modular Design—the two piece design allows installation in a broad range of equipment by providing flexibility in the type of sensor module or modules needed for the application.
3. Communications—The module can have an on-board TCP/IP stack, SPI port RS232 and/or USB port communications. The two-part system currently uses a hardware component and associated e.g., microprocessor, to handle communication needs. This may be eliminated in future designs for greater cost savings.
4. Size—The small size for an FPGA module allows mounting anywhere, and the tiny CMOS sensor module can be mounted very close to region of interest. Two piece designs provide great flexibility in mounting location.
5. Versatility—This constraint is answered by compact two piece modular design.
6. Cost—The actual mass production cost for the two-component system is under $250.
7. Simplicity—A black and white CMOS sensor provides an easily processed output signal.

The following is an example of one preferred card rank and/or suit identification algorithm used and hardware implementation provided in an actual CMOS card identification system. To simplify the process of identifying cards according to the invention, a number of design constraints were applied. They include:

1. The region of interest on the card is limited to a corner of the face of the card bearing the rank/suit information. This area is small so the imaging array can also be small.
2. There is sufficient difference in shapes and contours of images that it is not necessary to also distinguish on the basis of color. Only gray-scale images need be acquired and cards may be differentiated based only on shape and contour data from the images.
3. There is nothing in the way of texturing or shading on the card face that must be extracted from a surrounding image prior to conversion the gray-scale signals to binary values.
4. Since features such as shading or texturing do not need to be extracted from the image, a simple template matching algorithm identifies the card.

Identification Algorithm

Template matching works by comparing the cross correlation values of two independent matrices where the cross correlation of two matrices A and B is defined as:

$$\frac{\sum\sum A*B}{\sqrt{\sum\sum A*A*-\sum\sum B*B}}$$

Obviously this can require a large amount of computation resources, since for a known template, it must be shifted throughout the region of interest to determine if the template is present. This step can involve hundreds of matrix calculations. However, in the case where the values are binary (0 and 1), it can be shown that the cross-correlation can be reduced to a simple AND operation and summing of the matching values so that $$C_{ab}=\Sigma A \wedge B$$

This reduction provides an algorithm that is simpler, and can be performed with fewer resources, and at a lower cost. If applied in hardware instead of software, it can be implemented as a simple counter. However, this reduction suffers when multiple matches can occur for disparate images since there is no measure of the degree of mismatch. An example of a mismatch is when the system sees a diamond and a heart as identifiable. When a diamond is overlaid on a heart, the measure of match can be nearly identical. The sum of matches for the diamond and heart can actually exceed the sum of matches for a diamond and a diamond template if there is any distortion in the acquired image.

To overcome the problem of mismatching, let A' be the negative template (0=1 and 1=0) of A. Then the correlation sum:

$$C_{A'B}=\Sigma A' \wedge B$$

is a match of everywhere the matrices don't match. Then subtracting so that:

$$C_{AB}=\Sigma A \wedge B-\Sigma A' \wedge B$$

provides a measure of degree match with mismatch included. This difference is maximized when the template and acquired image match exactly. Since both operations are simple AND SUM operations, they can easily be implemented in hardware (e.g., the FPGA or ASIC) and then subtracted using counters and logic inside an FPGA. Since the exact location of an object within a matrix is unknown, and even the exact location in a known template of an object may be unknown, the template is typically shifted over the entire 'area'of an acquired image. It can be shown mathematically that if the matrix is converted into a single 1-D vector, shifting the template around on an image is as simple as shifting the index of the known vector being summed with respect to the corresponding index of the unknown vector.

Practically this means that a series of summations can be performed with counters addressing stored vectors into memory A series of correlations is performed shifting the index of one vector set thereby causing the effect of shifting a 2-D matrix over another 2-D field. Furthermore, no image need be reconstructed during extraction and identification. Simple 1-D vector output will serve for identification purposes.

Data Acquisition

The previous discussion lists only a method for identifying features. Prior to identifying features, a known set of vectors must be acquired and then unknown vectors must be compared. The comparison requires the use of a correlation algorithm. This section describes the technique for identifying and acquiring a region of interest for identification. A CMOS array can generate a 1-D signal representative of the scanned card. An optical position sensor may be provided to alert the system of the need to capture data by the CMOS array. A series of 1-D signals representative of a card passed over its surface is then generated.

Two exemplary methods of identification are described using template matching. In one, ranks are identified separately from suits and in the second, all 52 cards are identified separately, each by rank and by suit. As shown in FIG. 1, an optical position sensor 18 initiates the acquisition of data by the CMOS array 12 and the output from the array is sent to the FPGA 14 where the vector set is compared with known vectors to identify card rank and suit. In one preferred form of the invention, a reference vector set for each suit and each rank is stored in the FPGA.

CMOS Array

Black and white CMOS cameras typically output grey-scale values in 8 or 16 bit format. Binary conversion of the grey-scale value is then performed within the FPGA by a simple thresholding method where everything below a certain value is assigned a 0 and everything above is assigned a value of 1. This conversion is possible because color is not needed as a distinguishing factor in determining rank and/or suit.

Figure 2:
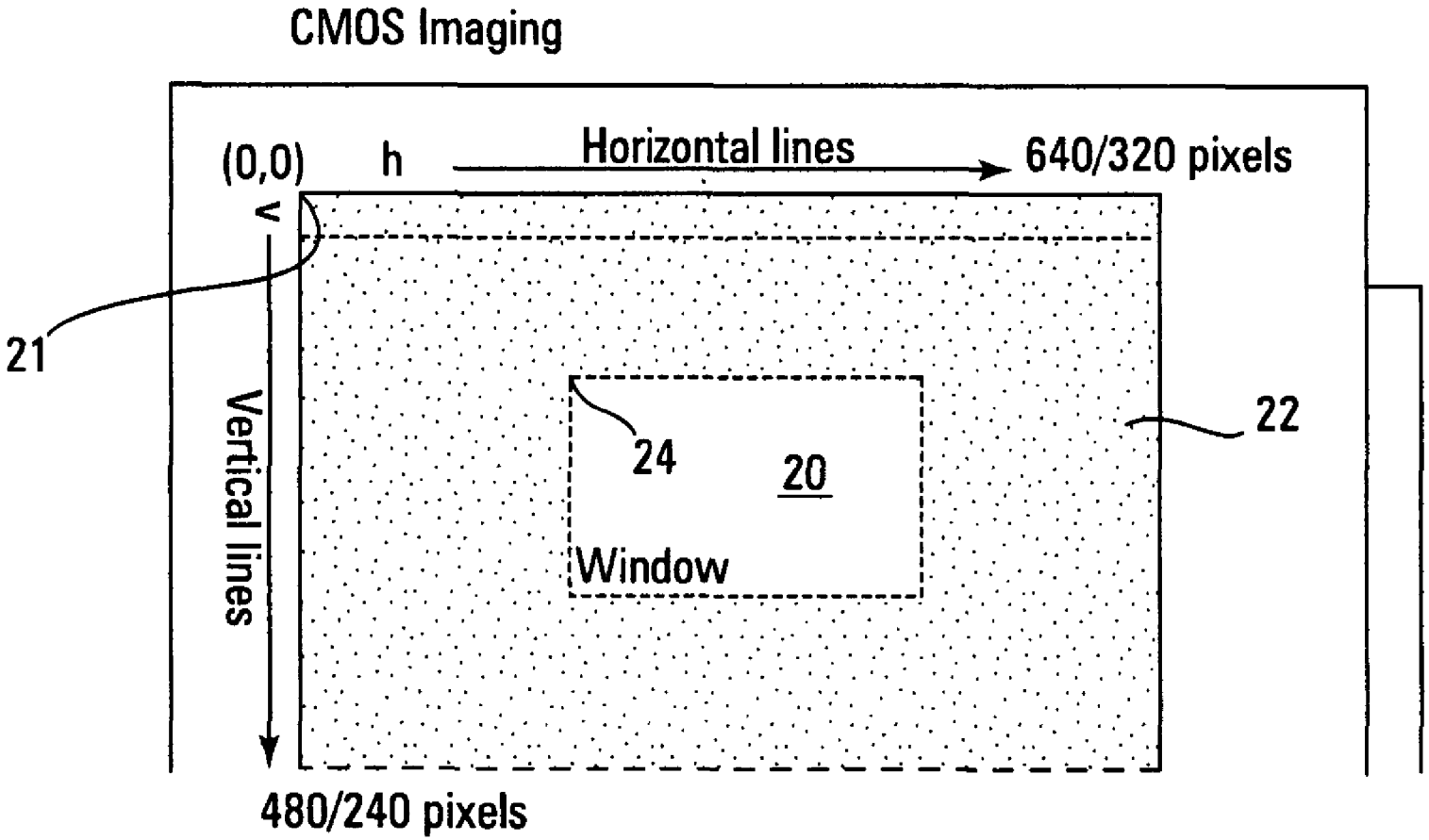
FIG. 2 shows scan area coordinates in a card scan.

For the present application in a CMOS imaging system for use with playing cards, an 8 bit digital CMOS 640×480 black and white array was selected, as greater detail is not needed to accurately identify rank and suit. The array format is shown in FIG. 2. The array is designed to operate in a QVGA (Quarter VGA) mode such that the resolution is only 320×240. QVGA mode is one preferred mode used for card identification (As previously noted, arrays as small as 48×144 or even smaller will suffice for card identification.)

Theory

As shown in FIG. 2, according to one example of the invention, the origin of the output signal is defined at point (0,0) 21. Then h and v directions (as labeled in the Registers section later) are defined. During operation, the array is able to output a signal representative of a smaller portion 20 of the entire array 22 if set up properly in the array controller. This smaller portion referred to as the window 20 is shown in the diagram. The smaller window 20 is defined in the camera operation setup and for the purposes of this application, a set of registers holds the starting points 24 for the window, known as h_start and v_start. The window size is defined by h_lines and v_lines. For instance, a smaller window can be outputted that starts at a point (h_start, v_start) and has a size in pixels of h_lines*v_lines is shown. In this fashion, the array can look at a selected region within the larger array by simply setting its start points and size. This windowing approach is advantageous to compensate for different card types and variability of array placement during the manufacturing process.

Figure 3:
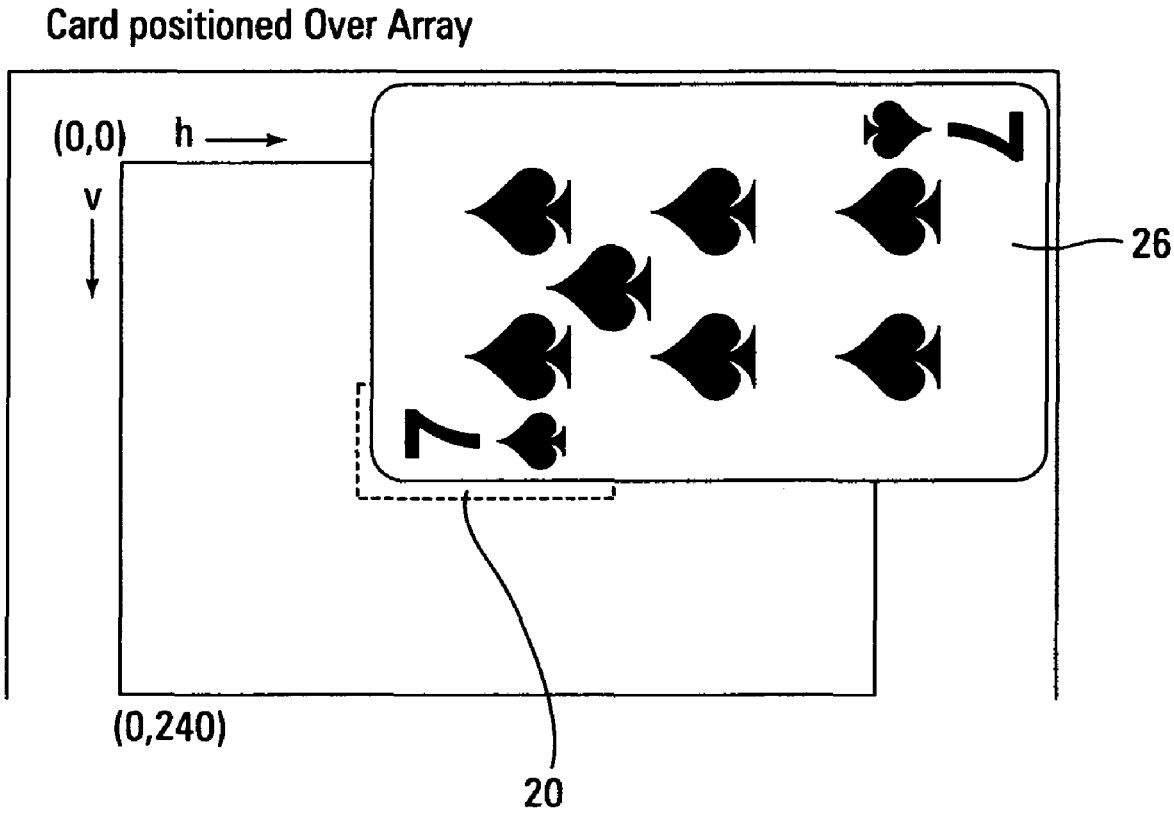
FIG. 3 shows a playing card positioned over a CMOS reader.

FIG. 3 shows an example card 26 positioned over the array window 20. The card is shown face-up for illustration only. During scanning, the card face is position face down over the window 20. Only a small portion of the card with rank and suit information need be detected so the window position and size is set appropriately for a given card type. Prior to signal acquisition, an optical sensor 18 senses the presence of a card.

After signal acquisition, a pair of LED object sensors 28 (shown in FIG. 1) senses when the card has passed completely over the CMOS sensor, turning the data acquisition off. When the data acquisition is turned off and then the position sensor 18 again senses a card, the FPGA collects data again from the CMOS sensor. During signal acquisition, a signal is acquired that represents the card image positioned over the window. However, the signal is not reconstructed into a 2-D image, it is stored as a 1-D vector in memory U ram.

Figure 4:
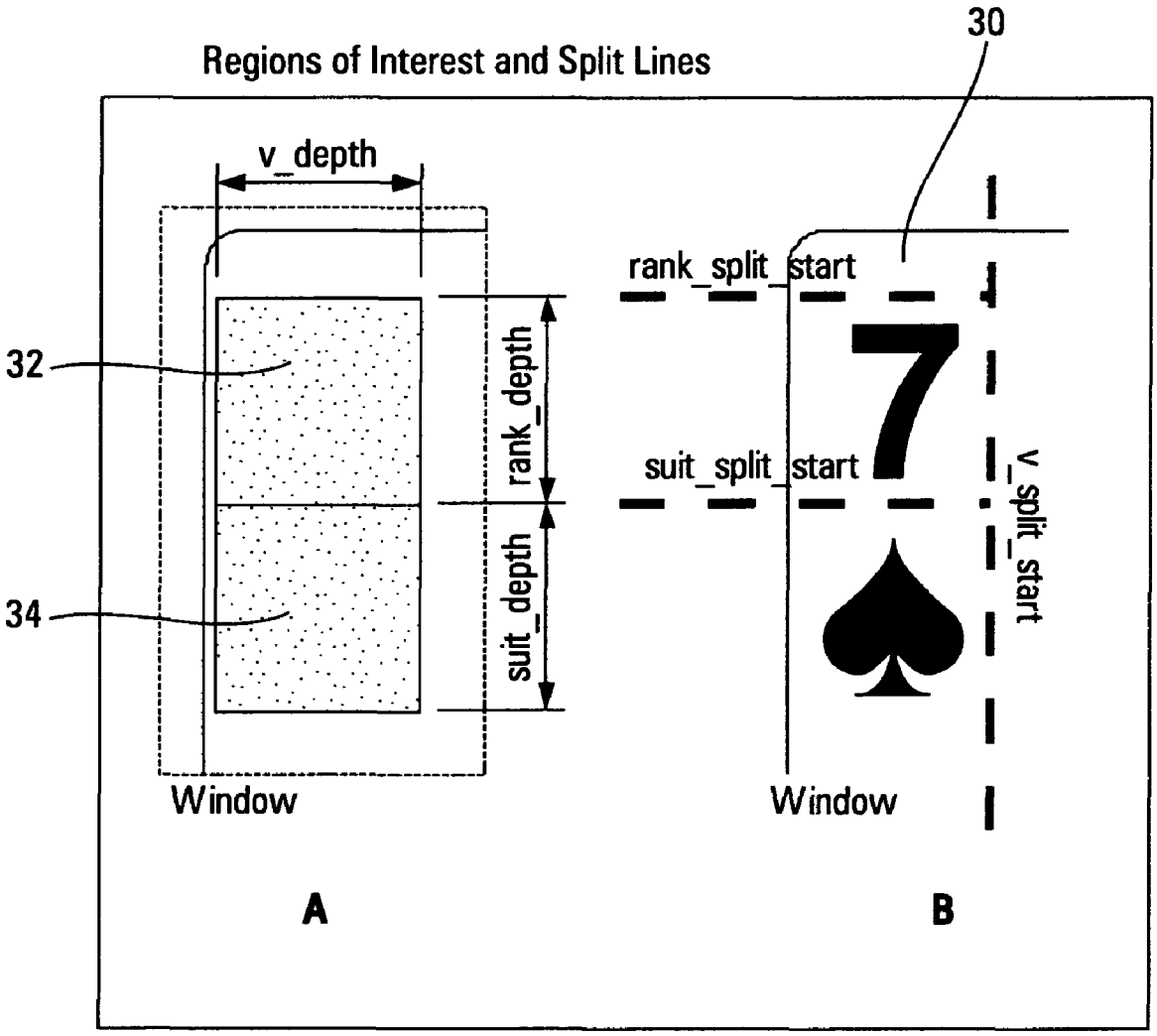
FIG. 4 shows regions of interest and split lines for a seven of Spades.

If the signal was to be reconstructed back into a 2-D array, the stored signal would appear something like that shown in FIG. 4 where the upper left corner 30 of a typical playing card 30 appears.

For card identification purposes using the previously mentioned template matching algorithm, two regions of interest 32 and 34 are identified. First a region of interest 32 is for the card rank is defined and second, region of interest 34 is for the card suit. The region of interest for each should be large enough to completely contain the rank or suit symbol with some additional area or 'padding' to account for variability in the acquired signal and variability in card position.

Figures 5A, 5B:
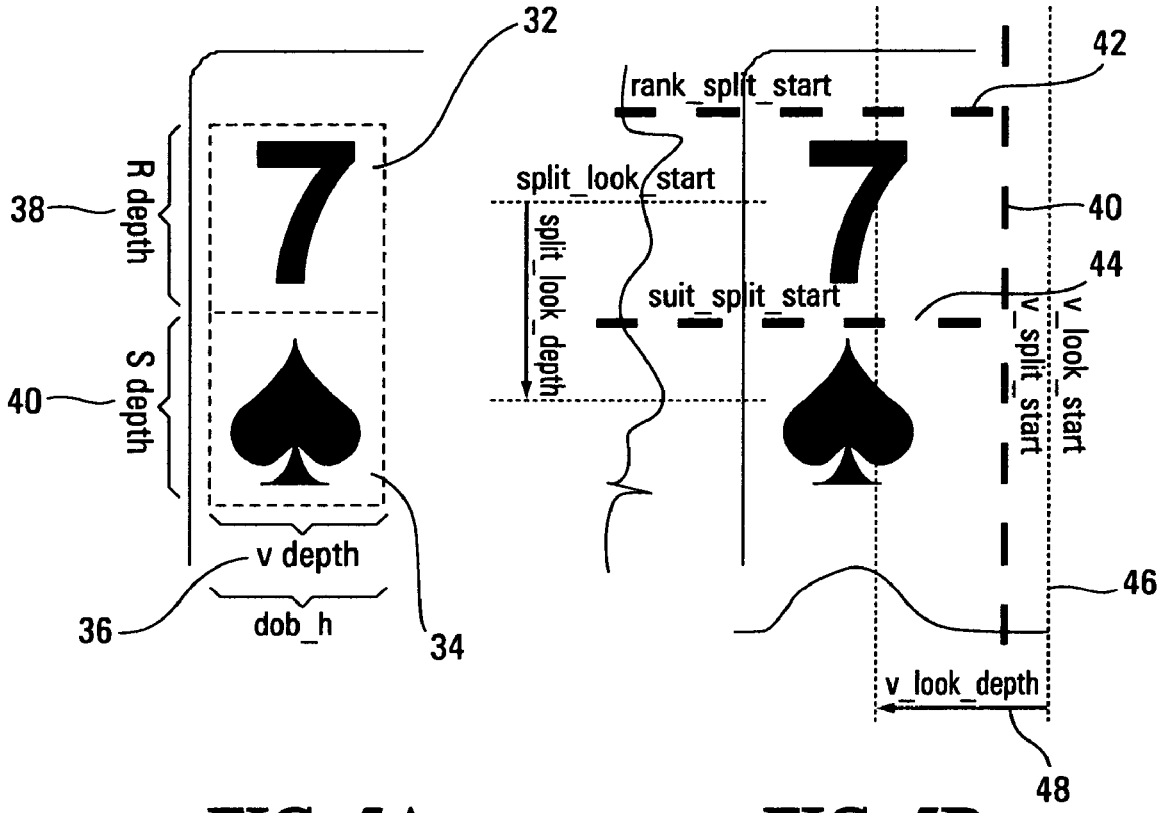
FIG. 5 shows column sums and split line data on the seven of Spades.

FIG. 5 shows an example of a method of defining regions of interest. In FIG. 5A, two regions 32 and 34 are defined, one that contains the card rank symbol 32 and the other that contains the card suit symbol 34. The size of the regions are defined by first the number of vertical lines required. This is referred to as v_depth 36. Then the depth of the rank and the suit regions are identified as rank_depth 38 and suit_depth 40. The sizes are settable registers in the FPGA to allow identification of differently sized rank and suit symbols found on different styles and brands of cards There is a relatively high degree of positioning error in a motorized (mechanized) playing card delivery shoe. While an image may be generated from the output signal of the camera, the exact location of the rank and suit symbols within the image are not known with a high degree of accuracy. However, certain features of the card are known and can be exploited for use in identifying the precise locations of a region of interest for matching purposes.

To account for positioning error and to locate the regions of interest accurately, a number of lines are defined. FIG. 5B shows the position of the lines. First, a line v_split_start 40 is defined as the vertical line position to locate one side of the region of interest. Then rank_split_start 42 and suit_split_start 44 are defined to locate the regions of interest precisely To precisely locate the split_start lines 40, 42, 44, a series of sums may be performed on the acquired signal. Each of the horizontal lines h is summed and stored in memory as dob_v. An algorithm then looks for the location of v_split_start by starting at v_look_start 46 and looking for the minima throughout the range set by v_look_depth 48. Several parameters are tunable such as the minimum threshold set in register v_threshold and the minimum width of the minima set in register v_width.

After locating the line v_split_start 40, the FPGA then generates the column sum dob_h and stores it in memory. A similar algorithm locates the point suit_split_start 44. The value rank_split_start 42 is then easily generated from suit_split_start 44−rank_depth 38. All the values are stored to registers.

Figure 6:
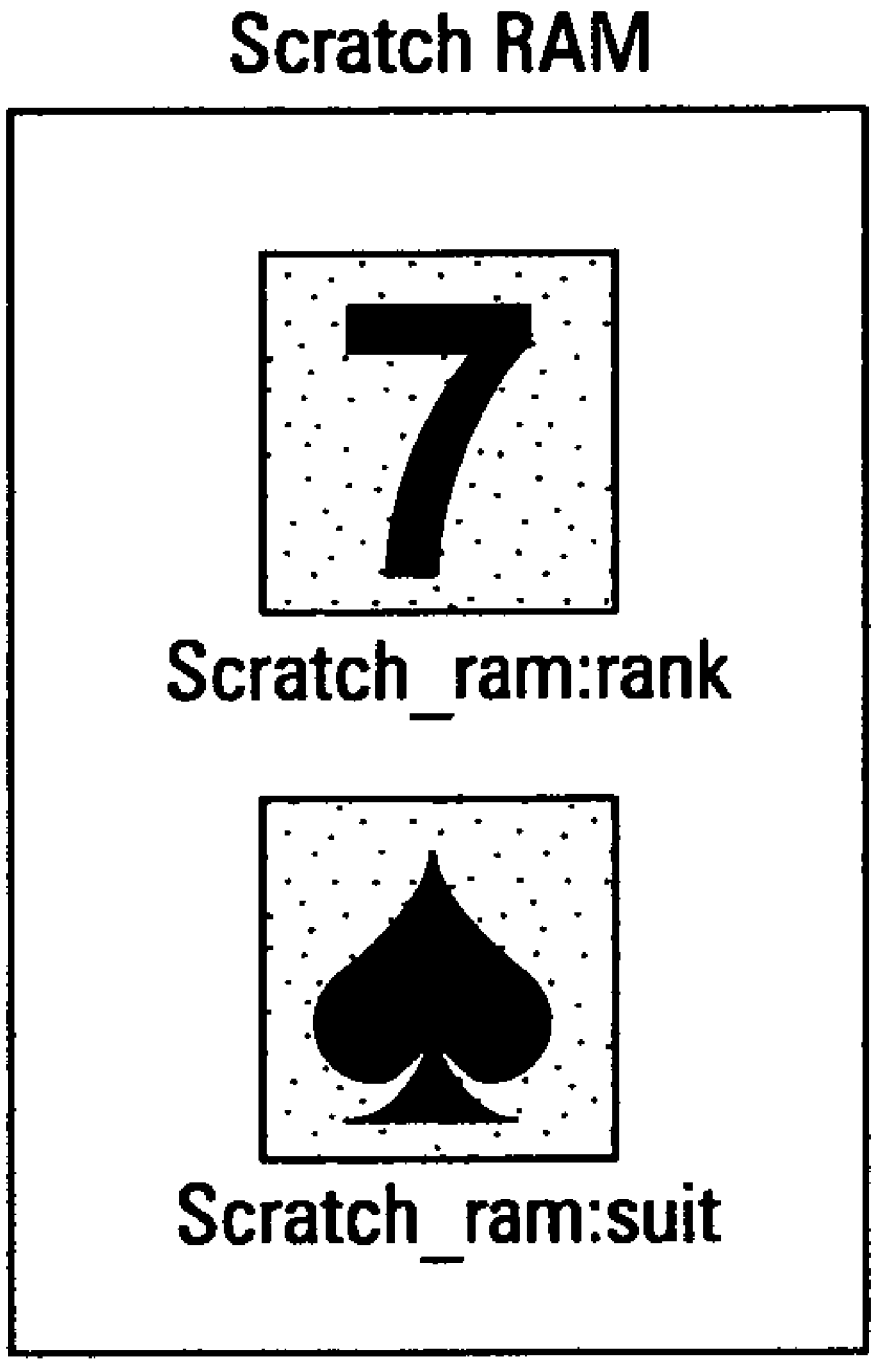
FIG. 6 shows the processed Scratch ram data of the seven of Spades.

Using the register values set for v_split_start, rank_split_start, and suit_split_start, contents of the U_ram memory is parsed into a second ram known as scratch_ram with rank and suit components. The scratch_ram is the actual working ram that is used for card identification. FIG. 6 shows and example of reconstructed images from signals from parsing the U_ram contents into scratch_ram. Although systems of the present invention do not use data to reconstruct images, image reconstruction can be approximated with the data to demonstrate the viability of the system. The contents of scratch RAM are used in correlating with of known rank and suit vector sets stored in RAM.

Data Acquisition

The previous section described the FGPA operation to acquire a signal from a CMOS array and manipulate the signal. This section shows examples of such an acquisition. Acquisition is triggered when a pair of LED sensors 28 indicate a card has been removed and then an optical sensor 18 indicates another card is present (FIG. 1). During acquisition, the array output undergoes a binary conversion inside the FPGA, or alternately, in the sensor. The array output is an 8 bit value and a conversion from the 8 bit value to 0 or 1 is made at a threshold level set by register threshold. The conversion may or may not be inverted. When the white sections of the card are converted to black (or 0) levels. This assists the template matching process. The images themselves are mirror images of cards as we see them because of how the array is mounted and the signal reconstructed. The alignment makes no difference to the identification algorithm.

Figure 7:
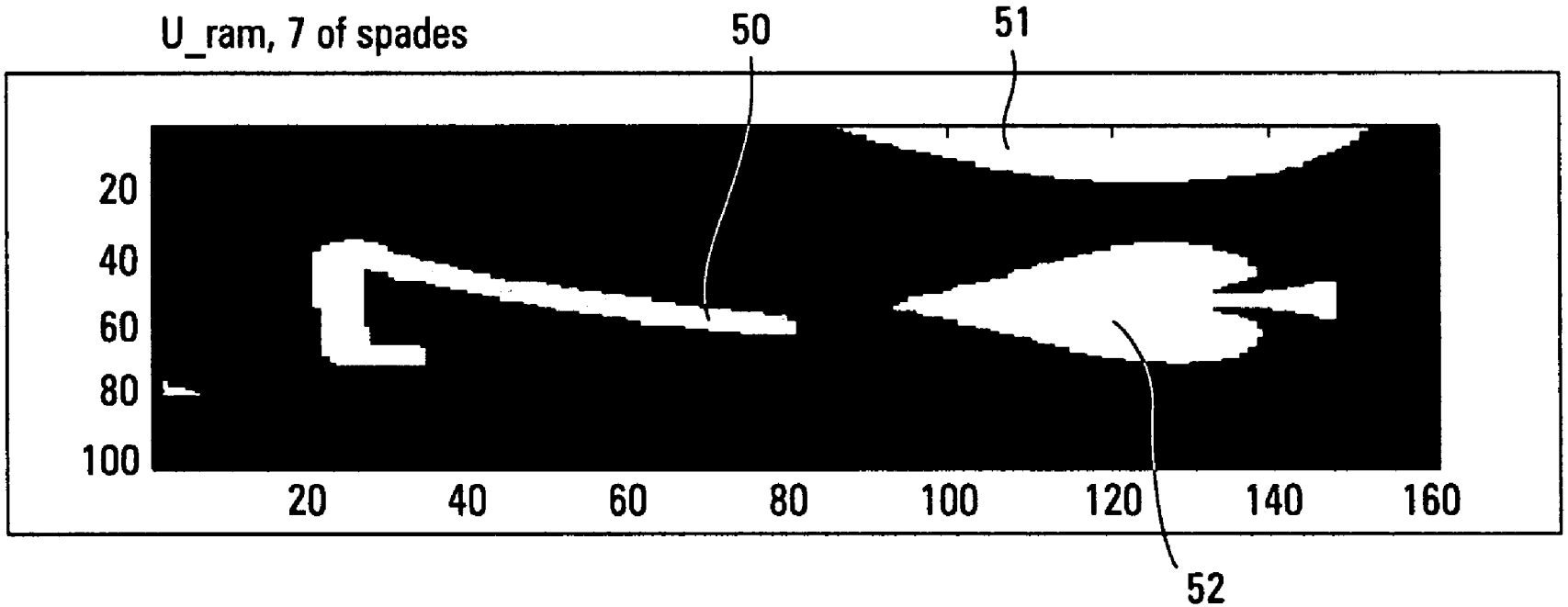
FIG. 7 shows the processed U ram data of the seven of Spades.
Figure 8:
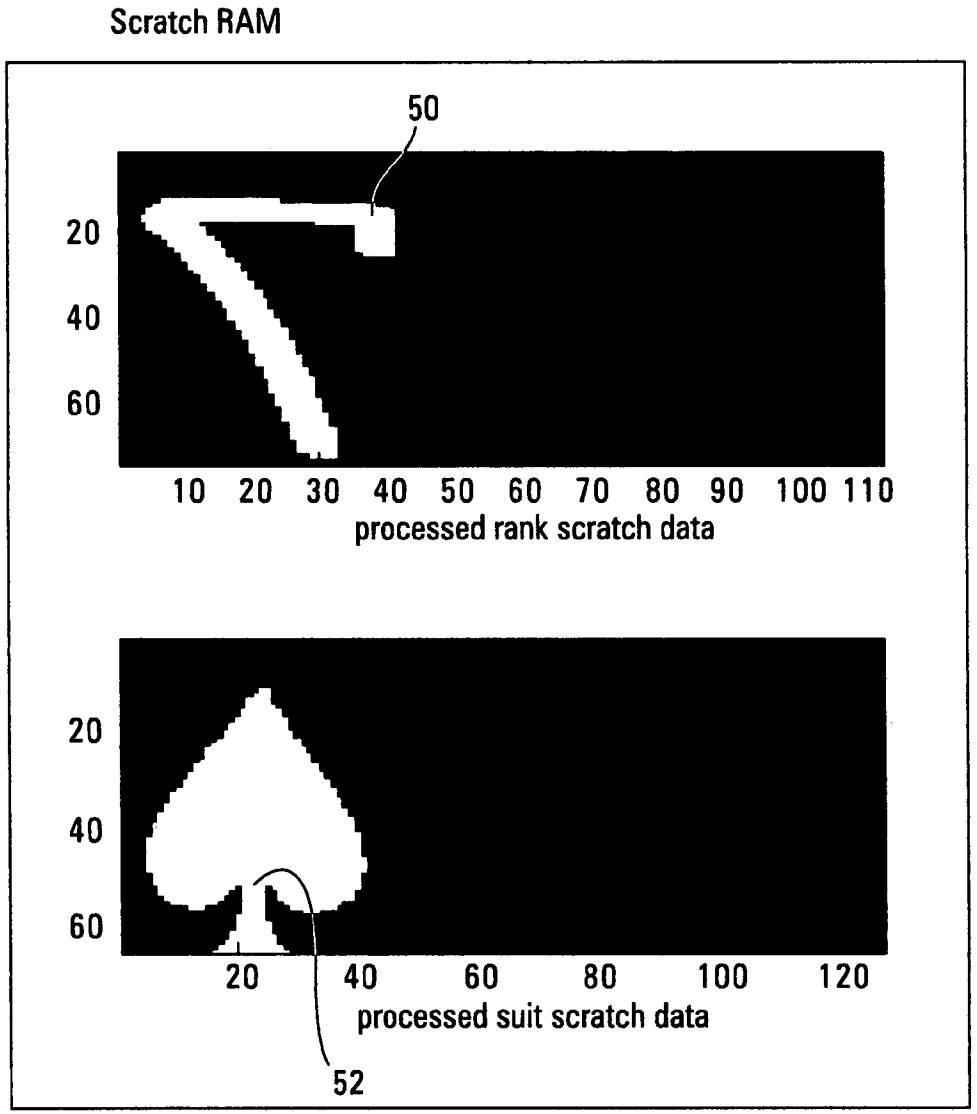
FIG. 8 shows the Scratch ram data of a processed rank and processed suit.

FIG. 7 shows a series of acquired signals that have been downloaded and reconstructed into 2-D images outside the FPGA to demonstrate accurate symbol identification. The Figure shows the large variation in location present in the shoe that necessitated the previously described method of locating first minima along the horizontal lines and then minima along the vertical lines. Additionally, face cards such as the Queen and Jack show additional information 51 from the artwork in the middle of the card. Again, this is filtered out of the U_ram signal when it is parsed into the scratch_ram. As shown in FIG. 8, the rank symbol 50 is a mirror image of the number 7. The suit symbol 52 is symmetrical so the scanned object looks identical to the acquired signal. FIG. 8 shows the data sample from FIG. 7 after it has been parsed into scratch_ram for identification.

Hardware

The module may be implemented, for example, using a commercially available FPGA coupled with an 8 bit microprocessor, and optionally coupled to object present sensing devices for activating the acquisition data.

Memory

The Xilinx™ XC3S1000 FPGA contains 14 block RAMs available for high speed read/write operations. This FPGA is available from XILINX of www.xilinx.com.

Operation

The following operation is specific to implementing the present 2-D cards sensing array in a mechanized shoe.

Status Registers

The FPGA status register provides information on the current state of the FPGA.

FPGA Status
Fpga_status (CS3 & 0x07)

| | Bit | | | | | | | |
|---|---|---|---|---|---|---|---|---|
| | 7 | 6 | 5 | 4 | 3 | 2 | 1 | 0 |
| Use | multi_card_error | motion_reverse_error | | | FSM_idle | Pic_done | card_id_read | lockup |

lockup - indicates FPGA locked up and requires reset.
card_id_read - indicates a card has been read
pic_done - indicates a picture is acquired
FSM_idle - indicates FPGA master FSM in idle mode
motion_reverse - indicates a card has come partially out of the shoe and moved back into shoe
multi_card_error - indicates a card has been pulled to soon after last card to have been read properly Shoe status
Shoe status (CS3 & 0x11)

| | Bit | | | | | | | |
|---|---|---|---|---|---|---|---|---|
| | 7 | 6 | 5 | 4 | 3 | 2 | 1 | 0 |
| Use | opt_ld_strom_active | shoe_open | shoe_empty | vfd_ok_to_send | vfd_busy | btn1_sw | btn2_sw | |

btn2_sw - button 2 has been pressed
btn1_sw - button 1 has been pressed
vfd_busy - VFD has set the busy line
vfd_ok_to_send - last message sent to VFD is finished
shoe_empty - no more cards in shoe
shoe_open - shoe lid is open
opt_ld_srom_active - indicates the fpga is loading the mouse sensor SROM, no read or writes during this time Control registers
ctl1
ctl1 (Ant 0x0D)

| | Bit | | | | | | | |
|---|---|---|---|---|---|---|---|---|
| | 7 | 6 | 5 | 4 | 3 | 2 | 1 | 0 |
| Use | read_dist_ram | rb_wr_ram | rb_status_clr | rb_rd_ram | rb_wr_mem | Rb_trigger | rb_ctl | rb_run |

rb_run - enables FSM to run
rb_ctl - lets rabbit take control of FSM
rb_trigger - rabbit triggers and acquisition and ID
rb_wr_mem - allows rabbit to write to memory
rb_rd_ram - allows rabbit to read RAM
rb_status_clr - clears status register
rb_wr_ram - allows rabbit to write to RAM
read_dist_ram - allows rabbit to read distributed RAM ctl2
ctl2 (Ant 0x0E)

| | Bit | | | | | | | |
|---|---|---|---|---|---|---|---|---|
| | 7 | 6 | 5 | 4 | 3 | 2 | 1 | 0 |
| Use | rb_trig_en | rb_sccb_en | rb_id_card | rb_div_pclk | rb_select_ram [3] | Rb_select_ram [2] | rb_select_ram [1] | rb_select_ram [0] |

rb_select_ram - 4 bit address used to select R RAM
rb_div_pclk - sets whether pclk divided in half when using high resolution
rb_id_card - causes a manual card ID
rb_sccb_en - allows comm with the camera
rb_trig_en - allows rabbit to generate an id card command (must be set prior to setting rb_id_card)

port. CCD scanners, however, require more power but produce higher-resolution scans. The resolution provided by a CCD scanner is more resolution than is needed for card rank and suit identification.

CMOS is an abbreviation for Complementary Metal Oxide Semiconductor. CMOS is a widely used type of semiconductor. CMOS semiconductors use both NMOS (negative polarity) and PMOS (positive polarity) circuits. Since only one of the circuit types is powered up at any given time, CMOS chips require less power than chips using just one type of transistor.

| ctl3<br>ctl3 (Post 0x72) | | | | | | | |
|---|---|---|---|---|---|---|---|
| | Bit | | | | | | |
| | 7 | 6 | 5 | 4 | 3 | 2 | 1 | 0 |
| Use | | | | | | | | clear_card_id |

clear_card_id - clears the card output escrow registers

| shoe I/O<br>shoe_IO (Post 0x81) | | | | | | | |
|---|---|---|---|---|---|---|---|
| | Bit | | | | | | |
| | 7 | 6 | 5 | 4 | 3 | 2 | 1 | 0 |
| Use | | | vfd_rst | btn2_led | btn1_led | Led_disp_1 | led_disp_0 | clear_shoe_status |

clear_shoe_status -
led_disp_0 -
led_disp_1 -
btn1_led -
btn2_led -
vfd_rst -

| CMOS I/O<br>CMOS_IO (Post 0x86) | | | | | | | |
|---|---|---|---|---|---|---|---|
| | Bit | | | | | | |
| | 7 | 6 | 5 | 4 | 3 | 2 | 1 | 0 |
| Use | opt_srom_ld | | | | opt_rab_ctl | optRST | cisLEDon | optNCS |

optNCS -
cisLEDon -
optRST -
opt_rab_ctl -
opt_srom_ld -

Figure 9:
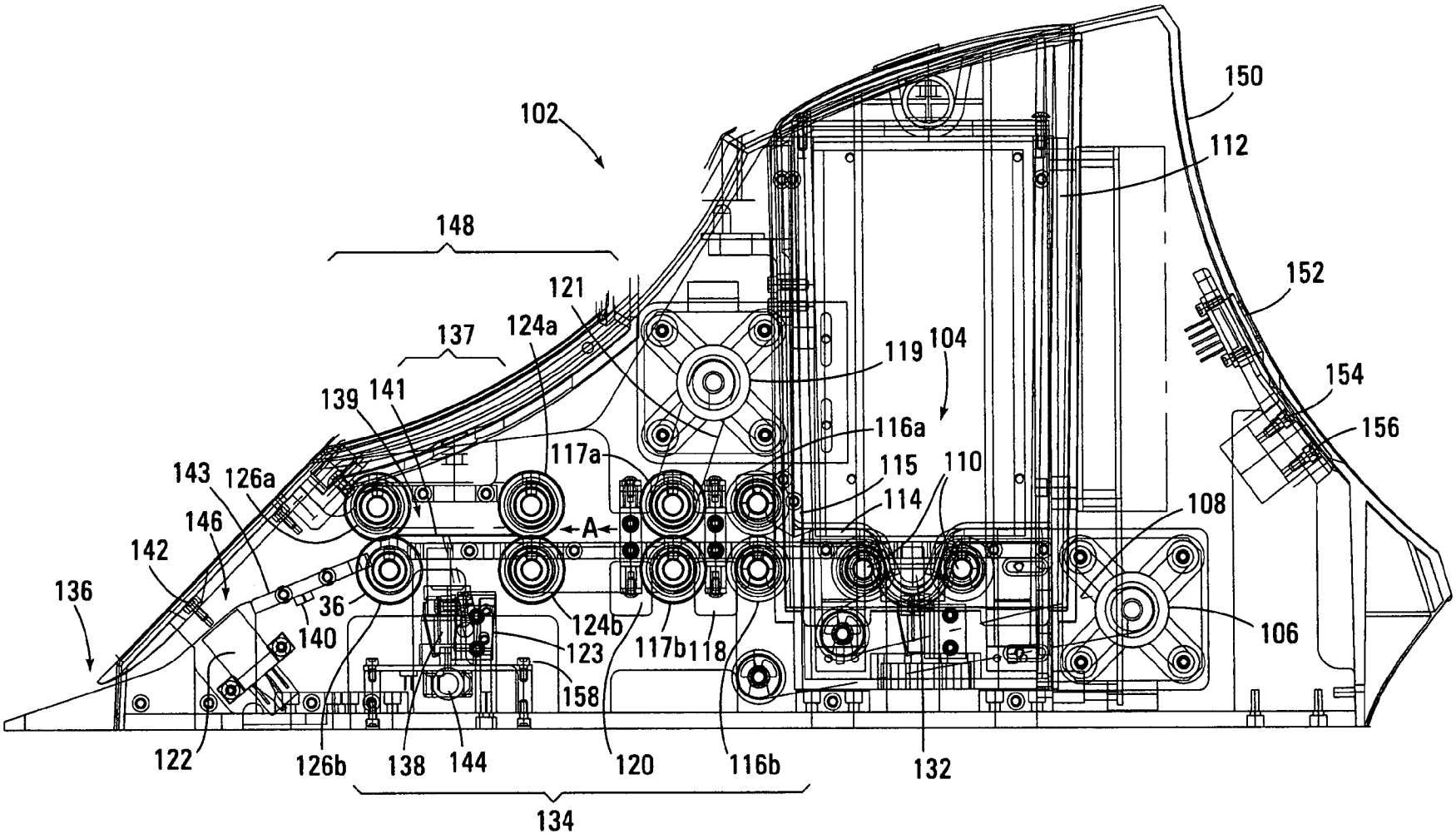
FIG. 9 shows a cutaway view of the side of a dealing shoe employing CMOS sensing according to the invention.

As shown in FIG. 9, the imager 122 may be located near the card exit 136 of a mechanized shoe 2. Alternatively, the sensor may be located within the buffer area, such as in area 123. The sensor 122 is connected to the FPGA logic circuit (not shown) inside the casing of the shoe 2. The imager 122 acquires data from each card being dealt during the game and the FPGA transmits the image information to an external PC (not shown). The FPGA determines the rank and or suit of each card. According to the present invention, the imager 122 and FPGA (not shown) are located internal to the shoe and the output of the FPGA contains a rank and or suit signal for each card dealt. The preferred CMOS imaging system gathers light, white or preferably green LEDs, and directs the light at the original document being scanned. A color-reading CMOS sensor is not required, as black-and-white images of the scans are sufficient to identify suit and rank. The light that is reflected from the original image is collected by a lens and directed at an image sensor array that rests just under the document being scanned. The sensor then records signals according to the intensity of light that hits the sensor. A CMOS scanner is more compact than a CCD scanner and can be used in smaller products than CCD scanning technologies. CMOS scanners also require less power than CCD scanners and often can run off battery power or the power from a USB In a copyrighted article of Micron, Inc. 2005, it has been reported that among the advantages of CMOS are that CCD sensors rely on specialized fabrication that requires dedicated—and costly—manufacturing processes. In contrast, CMOS image sensors can be made at standard manufacturing facilities that produce 90% of all semiconductor chips, from powerful microprocessors to RAM and ROM memory chips. This standardization results in economies of scale and leads to ongoing process-line improvements. CMOS processes, moreover, enable very large scale integration (VLSI), and this is used by "active-pixel" architectures to incorporate all necessary camera functions onto one chip. Such integration creates a compact camera system that is more reliable and obviates the need for peripheral support chip packaging and assembly, further reducing cost.

Active-pixel sensor CMOS architectures consume much less power—up to 100× less power—than their CCD counterparts. This is a great advantage in battery-dependent portable applications, such as laptop computers, hand-held scanners, and video cell phones. CCD systems, on the other hand, tend to be inherently power hungry. This is because CCDs are essentially capacitive devices, needing external control signals and large clock swings (5-15 volts) to achieve acceptable charge transfer efficiencies. Their off-chip support circuitry dissipates significant power. CCD systems require numerous power supplies and voltage regulators for operation, whereas active-pixel sensors use a single 5-volt (or 3.3-volt) supply, reducing power-supply inefficiency. A CCD system typically requires 2-5 watts (digital output), compared to 20-50 milliwatts for the same pixel throughput using an active-pixel system. For example, a CMOS digital camera system operating from a NiCd camcorder battery could operate for a week, while a CCD arrangement would drain the battery in a few hours.

In CMOS active-pixel image sensors, both the photo detector and the readout amplifier are part of each pixel. This allows the integrated charge to be converted into a voltage inside the pixel, which can then be read out over X-Y wires (instead of using a charge domain shift register, as in CCDs). This column and row addressability, similar to common DRAM, allows for window-of-interest readout (windowing), which can be utilized for on-chip electronic pan, tilt, and zoom. Windowing provides much added flexibility in applications that need image compression, motion detection, or target tracking.

With active-pixel architectures, the RMS input-referred noise is comparable to the very high-end (and expensive) CCDs. Both technologies provide excellent imagery compared with other CMOS image sensors. Active-pixel architectures use intra-pixel amplification in conjunction with both temporal and fixed-pattern noise suppression circuitry (i.e., correlated double sampling), which produces exceptional imagery in terms of dynamic range (a wide ~75 dB) and noise (a low ~15 e-RMS noise floor), with low fixed-pattern noise (<0.15% sat). Active-pixel sensors achieve a quantum efficiency (sensitivity) that is comparable to high-end CCDs, but, unlike CCDs, they are not prone to column streaking due to blooming pixels. This is because CCDs rely on charge domain shift registers that can leak charge to adjacent pixels when the CCD register overflows, causing bright lights to "bloom" and leading to unwanted streaks in the image.

In active-pixel architectures, the signal charge is converted to a voltage inside the pixel and read out over the column bus, as in a DRAM. The sensors have built-in anti-blooming protection in each pixel, so that there is no blooming. Smear, caused by charge transfer in a CCD under illumination, is also avoided.

CMOS active-pixel designs are inherently fast, which is a particular advantage in machine-vision and motion-analysis applications. Active pixels can drive an image array's column buses at greater speeds than is possible on passive-pixel CMOS sensors or CCDs, and on-chip analog-to-digital conversion (ADC) eases the driving of high-speed signals off-chip. A separate benefit of on-chip ADCs is the output signal's low sensitivity to pick-up or crosstalk. This facilitates computer and digital-controller interfacing while adding to system robustness.

CMOS active-pixel architectures allow signal processing to be integrated on-chip. Beyond the standard camera functions—AGC, auto-exposure control, etc.—many higher-level DSP functions can be realized. These include anti-jitter (image stabilization) for camcorders, image compression (before and after readout), color encoding, computer data bus interface circuits, multi-resolution imaging, motion tracking for perimeter surveillance ("smart image sensing"), video conferencing, and wireless control.

CMOS logic is based on the use of complementary MOS transistors to perform logic functions with almost no current required. This makes these gates very useful in battery-powered applications. The fact that they will work with supply voltages as low as 3 volts and as high as 15 volts is also very helpful.

Figure 8A:
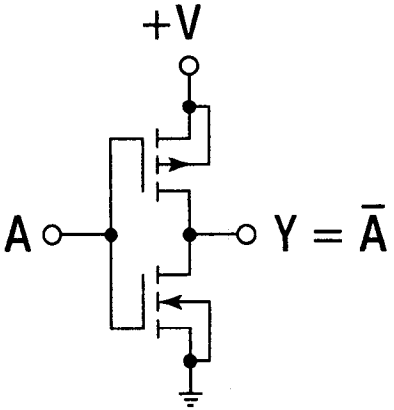
FIG. 8A is a CMOS gate based on a fundamental inverter circuit.

As shown in FIG. 8A, CMOS gates are all based on a fundamental inverter circuit. Both transistors are enhancement-mode MOSFETs; one N-channel with its source grounded, and one P-channel with its source connected to +V. Their gates are connected together to form the input, and their drains are connected together to form the output. The two MOSFETs are designed to have matching characteristics. Thus, they are complementary to each other. When the transistor is off, their resistance is effectively infinite; when on, their channel resistance is about 200Ω. Since the gate is essentially an open circuit, it draws no current, and the output voltage will be equal to either ground or to the power supply voltage, depending on which transistor is conducting.

When input A is grounded (logic 0), the N-channel MOSFET is unbiased, and therefore has no channel enhanced within itself. It is an open circuit, and therefore leaves the output line disconnected from ground. At the same time, the P-channel MOSFET is forward biased, so it has a channel enhanced within itself. This channel has a resistance of about 200Ω, connecting the output line to the +V supply. This pulls the output up to +V (logic 1).

When input A is at +V (logic 1), the P-channel MOSFET is off and the N-channel MOSFET is on, thus pulling the output down to ground (logic 0). Thus, this circuit correctly performs logic inversion, and at the same time provides active pull-up and pull-down, according to the output state.

Figure 8B:
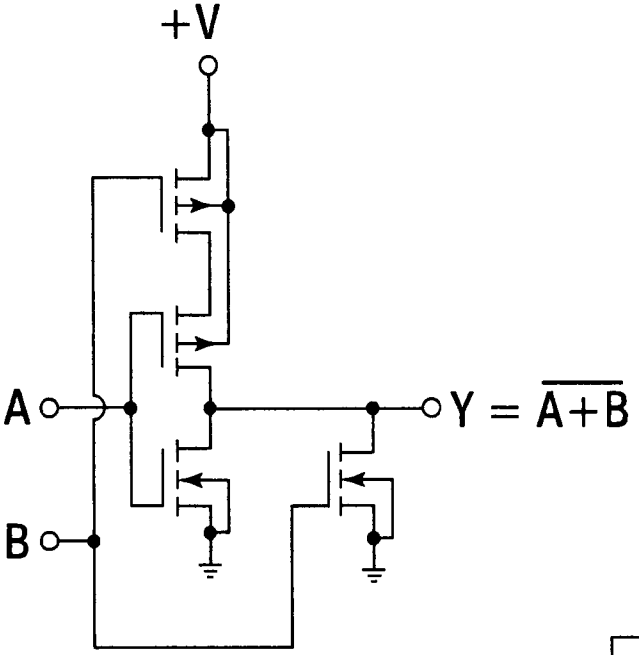
FIG. 8B is a CMOS gate expanded into NOR and NAND structures.

This concept can be viewed in FIG. 8B and shown to be expanded into NOR and NAND structures by combining inverters in a partially series, partially parallel structure. The circuit shown in the figure is a practical example of a CMOS 2-input NOR gate.

In this circuit, if both inputs are low, both P-channel MOSFETs will be turned on, thus providing a connection to +V. Both N-channel MOSFETs will be off, so there will be no ground connection. However, if either input goes high, that P-channel MOSFET will turn off and disconnect the output from +V, while that N-channel MOSFET will turn on, thus grounding the output.

Figure 8C:
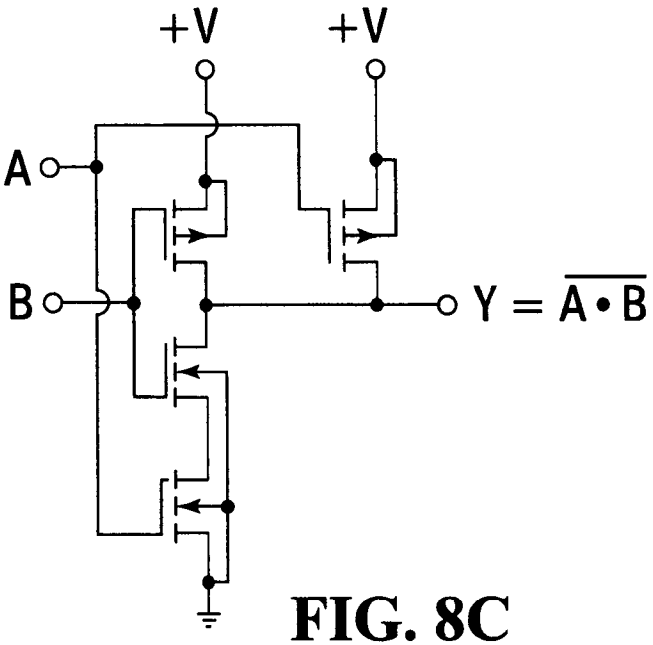
FIG. 8C illustrates an inverted structure.

In FIG. 8C, its is shown that the structure can be inverted, as shown to the left. Here we have a two-input NAND gate, where a logic 0 at either input will force the output to logic 1, but it takes both inputs at logic 1 to allow the output to go to logic 0.

This structure is less limited than the bipolar equivalent would be, but there are still some practical limits. One of these is the combined resistance of the MOSFETs in series. As a result, CMOS totem poles are not made more than four inputs high. Gates with more than four inputs are built as cascading structures rather than single structures. However, the logic is still valid.

Figure 8D:
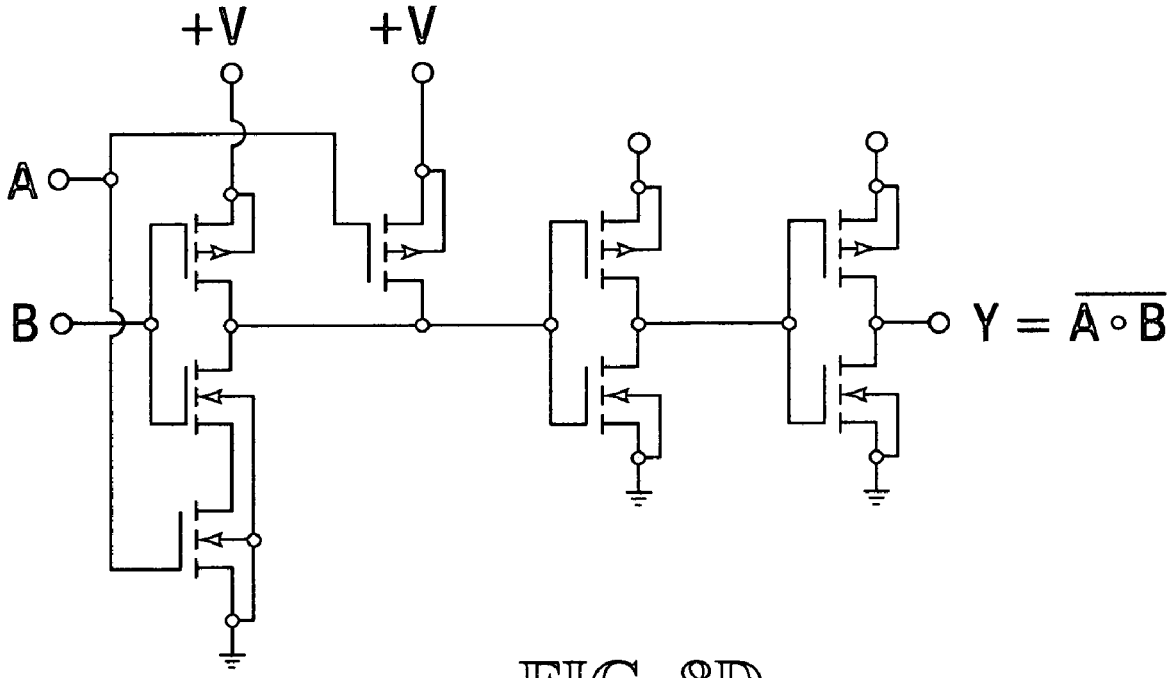
FIG. 8D illustrates B-series CMOS gates.

Even with this limit, the totem pole structure still causes some problems in certain applications. The pull-up and pull-down resistances at the output are never the same, and can change significantly as the inputs change state, even if the output does not change logic states. The result is uneven and unpredictable rise and fall times for the output signal. This problem was addressed, and was solved with the buffered, or B-series CMOS gates, shown in FIG. 8D.

The technique here is to follow the actual NAND gate with a pair of inverters. Thus, the output will always be driven by a single transistor, either P-channel or N-channel. Since they are as closely matched as possible, the output resistance of the gate will always be the same, and signal behavior is therefore more predictable.

One of the main problems with CMOS gates is their speed. They cannot operate very quickly, because of their inherent input capacitance. B-series devices help to overcome these limitations to some extent, by providing uniform output current, and by switching output states more rapidly, even if the input signals are changing more slowly.

Not all of the details of CMOS gate construction have been described here, but one skilled in the art is available of the design flexibility in CMOS and would not interpret this description as limiting practice of the technology to the specific embodiments shown. For example, to avoid damage caused by static electricity, different manufacturers developed a number of input protection circuits, to prevent input voltages from becoming too high. However, these protection circuits do not affect the logical behavior of the gates, so the description of the protection circuit has been omitted.

Figure 8E:
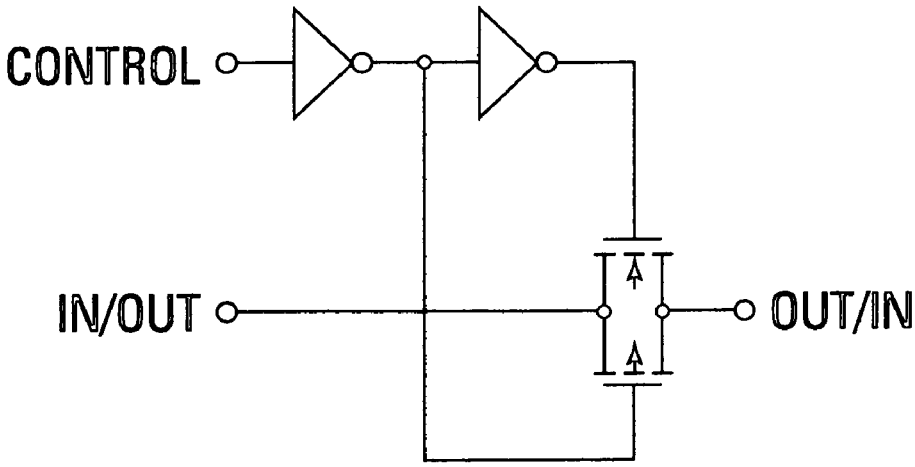
FIG. 8E illustrates a bilateral switch CMOS gate.

One type of gate, shown in FIG. 8E, is unique to CMOS technology. This is the bilateral switch, or transmission gate. It makes full use of the fact that the individual FETs in a CMOS IC are constructed to be symmetrical. That is, the drain and source connections to any individual transistor can be interchanged without affecting the performance of either the transistor itself or the circuit as a whole.

When the N- and P-type FETs are connected and their gates are driven from complementary control signals, both transistors will be turned on or off together, rather than alternately. If they are both off, the signal path is essentially an open circuit—there is no connection between input and output. If they are both on, there is a very low-resistance connection between input and output, and a signal will be passed through.

In the use of the prior art camera imaging systems, even though the device operated well and was a significant advance in technology, the image capture technology was too bulky and expensive to implement. Also, transmitting the image of a card from the shoe to an external computer prior to its distribution on the table can cause security issues. Since data is transmitted outside of the shoe, it is possible to read the data using a sophisticated data receiver. This creates an opportunity to cheat the system. It is therefore desirable to provide an apparatus and method that is capable of determining the rank and suit of a card without using expensive equipment and without sacrificing speed or accuracy. It is also desirable to reduce the size of the device so it can fit entirely within the confines of a shoe. The use of CMOS assists in accomplishing that further advance in technology.

Because of the low power requirements of the CMOS imaging systems of the present invention, a battery power supply could be used to power the device.

The card sensing system of the present invention may be used a variety of ways in order to be useful in providing card rank and or suit information in real time from a live table game. Nonlimited examples of uses of the card rank and/or suit identification device of the present invention include a) as a table-top card sensing system, b) as part of a mechanized shoe that moves cards within the shoe, c) as part of a standard shoe with card reading sensor at the exit end, d) as part of a shuffler, including a continuous shuffler, a batch shuffler and a hand-forming shuffler, e) as part of a deck verification device, and f) as part of a discard rack capable of moving cards over a sensor.

CMOS Sensing System in a Mechanized Shoe

Reference to the remaining Figures will also help in an appreciation of the nature and structure of one embodiment of the card delivery shoe of the invention that is within the generic practice of the claims and enables practice of the claims in this application.

FIG. 9 shows a mechanized card delivery shoe 102 according to the present invention. The card delivery shoe 102 has a card infeed or card input area 104 which is between motor 119 and the rear panel 112 of the card delivery shoe 102. A belt driving motor 106 drives a belt 108 that engages pick off rollers 110. These pick off rollers 110 pick off and move individual cards from within the card infeed area 104. A belt driving stepper motor 106 is shown but other motor types such as gear drives, axle drives, magnetic drives and the like may be alternatively used. The pick off rollers 110 drive individual playing cards (not shown) into a gap 114 having a deflector plate 115 to direct cards individually through the gap 114 to engage brake rollers 116. The brake rollers 116*a*, 116*b* control the movement of individual cards into the card staging area 134. The brake rollers 116*a*, 116*b* are capable of becoming free-turning rollers during a card jam recovery process so that little or no tension is placed on a card as it is being moved by the system or manually to free a jam. A simple gear release or clutch release can affect this function. Speed up rollers 117*a*, 117*b* apply tension to a card to move it more deeply into the card staging area 134. The speed up rollers can and may turn faster then the braking rollers 116*a*, 116*b*, and the speed up rollers 117*a*, 117*b* may be driven by a separate motor 119 and belt drive 121. A card path and direction of movement A is shown through the card staging area 134. As individual cards are passed along the card path A through the card staging area 134, there are card presence sensors 118, 120, located at various intervals and positions to detect the presence of cards to assure passage of cards and/or to detect stalled or jammed cards. The path A through the card storage area 134 is in part defined by speed-up rollers 117*a*, 117*b* or rear guide rollers 124*a*, 124*b* and forward guide rollers 126*a*, 126*b* which follow the brake rollers 116*a*, 116*b* and then the speed up rollers 117*a*, 117*b*. One form of a buffer area 148 is established by the storing of cards along card path A. As cards are withdrawn from the delivery end 136 of the delivery shoe 102, additional cards are fed from the buffer area 148 into the card feed chute 146 into the delivery end 136. As noted earlier, the mechanized delivery shoe is preferred, but a purely mechanical shoe, little different from standard non-imaging shoes used in casinos, may be provided with the imager described herein and the signals provided there from sent to hardware that transforms the signals, software that processes the signals, intermediate storage systems and/or final storage systems for use at appropriate times. The description will emphasize the delivery shoe (which may also be the output element of a shuffler) that automatically moves and delivers cards, only because that is a preferred embodiment, not because that is the only format of shoe that can be used with the described imaging technology.

It is always possible for cards to jam, misalign or stick during internal movement of cards through the dealing shoe. There are a number of mechanisms that can be used to accomplish jam recovery. The jam recovery may be based upon an identified (sensed) position of jam or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 9 within the dealing shoe (e.g., between and inclusive of rollers 116*a*, 116*b* and 117*a*, 117*b* will be discussed from an exemplary perspective, but the discussion relates to all other positions within the device.

If a card is sensed (e.g., by sensors 118 and/or 120) as jammed between rollers 116 and 117 (e.g., a jam occurs when cards will not move out of the position between the rollers within a specified time limit and/or cards refuse to be fed into that area), one of a various number of procedures may be initiated to recover or remove the jam. Among the various procedures which are discussed by way of non-limiting examples include at least the following. The rear-most set of rollers (116*a* and 116*b*) may reverse direction (e.g., 116*a* begins to turn clockwise and 116*a* begins to turn counter-clockwise) to remove the jammed card from between the rollers (116*a* and 116*b*) and have the card extend backwards into the space 114, without attempting to reinsert a card into the stacking area 4. The reversed rotation may be limited to assure that the card remains in contact with the rollers 116*a* and 116*b*, so that the card can be moved back into progression through the dealing shoe. An optional part of this reversal can include allowing rollers 117*a* and 117*b* to become free rolling to release contact and tension on the card during the reversal. The reversed rotation may be smoothly run or episodic, attempting to jerk a jammed card from its jammed position. If that procedure does not work or as an alternative procedure, both sets of rollers 116*a*, 116*b* and 117*a*, 117*b* may reverse at the same time or in either sequence (e.g., 116*a*, 116*b* first or 117*a*, 117*b* first) to attempt to free the jam of a card. When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., 116*a*, 116*b* and 117*a*, 117*b*) can act in coordination, in sequence, in tandem, in order, independently or in any predefined manner. For example, referring to the roller sets as 116 and 117, the recovery process may have the rollers act as a) (116-117) at the same time in the same direction), b) (116-117) at the same time in the opposite directions to assist in straightening out cards, c) (116 then 117) to have the rollers work sequentially, d) (117 then 116) to have the rollers work in a different sequence, e) 116 only for an extended time, and then 117 operating alone or together with 116, f) 117 only for an extended time or extended number of individual attempts and then 116 for a prescribed time, etc. As noted earlier, a non-active roller (one that is not attempting to drive or align cards) may become free-rolling during operation of another roller.

These various programs may be performed at a single jam location in series or only a single program for jam recovery may be affected. In addition, as the card may have been read at the point of the jam or before the jam, the rank and value of the card jammed may be identified and this can be displayed on the display panel on the dealing shoe, on the central computer or on a shuffler connected to the dealing shoe, and the dealer or pit boss may examine that specific card to make certain that no markings or damage has occurred on that card which could either cause further problems with the dealing shoe or shuffler or could enable the card to be identified when it is in the dealing position in the shoe at a later time. The operator can then correct any problem by replacement of that specific card, which would minimize down time at the card table. Also, if a jam cannot be automatically recovered, the shoe display would indicate a jam recovery failure (e.g., by a special light or alphanumeric display) and the operator would open the device and eliminate the jam manually.

Individual playing cards (not shown) may be read at one or more various locations within the card delivery shoe 102. The ability to provide multiple read locations assures performance of the shoe, while other card delivery trays with read capability usually had a single reading position at the point where and when cards were removed from the shoe for delivery to players. For example, in the construction shown in FIG. 1, the card presence sensors 118, 120 may also have card reading capabilities, and other card reading sensors may be present as elements 132, 140 and 142.

Element 138 may be present as another sensing element or a card value (and possibly suit) reading element without the presence of sensor 122 or in combination with sensor 122. When the sensor 138 such as a CMOS sensor with FPGA control logic functions as a card reading element, it can read the cards as they are positioned within the card buffer area 137, rather then as the cards are removed from the card delivery end 136. Information may be read by the card reading sensor 138 by either continuous reading of all image data in the card pre-delivery or buffer area or by triggered on-off imaging of data in a specific region of cards 139 as a card 141 is within the pre-delivery area 137. For example, card presence sensor 122 may activate sensor 138. This sensor is preferably a CMOS sensor with FPGA control logic. A light source (not shown) may be provided to enhance the signal to the sensor 138. One preferred light source is a green diode. The green diode causes the red print on the cards to appear black to the CMOS sensor. That specific region of cards is preferably a corner of the card 141 wherein complete value information (and possibly suit information) is readable on the card, such as a corner with value and suit ranging symbols on the card. That region could also be the entire face of the card, or at lease ½ of the card (lengthwise divided). By increasing the area of the region read more processing and memory is required, but accuracy is also increased. Accuracy could also be increased, by reading the upper right hand corner of the card and lower left hand corner, since both of those locations contain the rank and suit of the card. By reading 2 locations on the card, and comparing the derived rank and suit data, correct identification can be confirmed. By using on-off or single shot imaging of each card 141, the data flow from the sensor/card reading element 138 is minimized and the need for larger memory and data transmission capability is reduced in the system.

Information may be transferred from the card reading elements (e.g., 138) from a communication port or wire 144 shown for sensor/reading element 138. Cards may be buffered or staged at various points within the dealing shoe 102, such as where restrained by rollers 126*a*, 126*b* so that cards partially extend towards the chute 146 past the rollers 128*a*, 128*b* on plate 143, or staged between rollers 124*a*, 124*b* and 126*a*, 126*b*, between rollers 117*a*, 117*b* and 124*a*, 124*b*, between rollers 116*a*, 116*b* and 117*a*, 117*b* and the like. Cards may partially overlap in buffering as long as two or more cards are not present between a single set of nip rollers (e.g., 126*a*, and 126*b*) where nip forces may drive both cards forward at the same time.

Other variations are available and within the skill of the artisan. For example, rear panel 112 may have a display thereon for displaying information or data, particularly to the dealer (which information would be shielded from players as the rear panel 112 would primarily face the pit and be shielded from players' view. A more ergonomic and aesthetic rear surface 150 is shown having a display 152 that is capable of providing alphanumerics (letters and numbers) or analog or digital images of shapes and figures in black-and-white or color. For example, the display may give messages as to the state of the shoe, time to number of cards dealt, the number of deals left before a cut card or virtual cut card is reached (e.g., the dealing shoe identifies that two decks are present, makes a virtual cut at 60 cards, and based on data input of the number of players at the table, identifies when the next deal will be the last deal with the cards in the shoe), identify any problems with the shoe (e.g., low power, card jam, where a card is jammed, misalignment of cards by rollers, and failed element such as a sensor), player hands, card rank/suit dispensed, game outcome information, game play instructions and the like. Also on the rear surface 150 are two lights 154 and 156, which are used to show that the shoe is ready for dealing (e.g., 154 is a green light) or that there is a problem with the dealing capability of the shoe (e.g., 156 is a red light). The memory board 158 for the card reading sensor 138 is shown with its information outlet 144 shown.

There are significant technical and ergonomic advantages to the present structure. By having the card infeed area 104 provide the cards in at least a relatively vertical stack (e.g., with less then a 60° slope of the edges of the cards away from horizontal), length of the delivery shoe 102 is reduced to enable the motor driven delivery and reading capability of the shoe in a moderate space. No other card delivery shoes are known to combine vertical card infeed, horizontal (or approximately horizontal ±40° slope or ±30° slope away from horizontal) card movement from the infeed area to the delivery area, with mechanized delivery between infeed and delivery. The motor drive feed from the vertical infeed also reduces the need for dealers to have to jiggle the card tray to keep cards from jamming, slipping to undesirable angles on the chutes, and otherwise having to manually adjust the infeed cards, which can lead to card spillage or exposure as well as delaying play of the game.

Certain aspects of the invention may alternatively be described as a card storage shoe comprising a card infeed area where an approximately vertical set of cards can be seated. The shoe could have a card moving element that moves one card at-a-time from the approximately vertical set of cards. There could be an automatic mechanical transporting system for horizontally transporting individual ones of cards moved from the vertical set of cards to a card delivery area. There is preferably (but optionally) a card reading system that reads at least one of suit, rank and value of cards before read cards become stationary in the card delivery area. In one embodiment, a buffer area is present between the card infeed area and the card delivery area and at least some cards remain stationary for a time in the buffer area before being delivered to the card delivery area. Cards may be read, for example, entering or while stationery in the buffer area. In one embodiment, only one card is present in the card buffer area at any time. It is one aspect of an embodiment of the invention for cards to be read in the shoe after they leave the card buffer area but before they are completely stationary in the card delivery area. They may be read when stationery in the card buffer area, but not in the card delivery area. There may be more than one sensor present along a path between the card infeed area and the card delivery area to detect the presence of cards at specific locations.

There may be design and function reasons in certain embodiments to have a sensor-reader (e.g., a camera or any other form of image detector) read cards discontinuously when the sensor-reader is triggered by a card detection sensor in the shoe.

A method is available for providing a card to a dealer for manual delivery of the cards by a dealer, the method comprising:

placing a set of cards within a card infeed area;

mechanically moving cards from the set of cards from the card infeed area to a card delivery area where at least some cards become stationary;

reading individual cards for at least one of rank, suit or value after the cards are removed from the card infeed area and before the cards become stationary in the card delivery area.

The method may include placing the set of cards in an approximately vertical stack in the card feed area. At least one card from the set of cards may be moved to a buffer area between the infeed area and the card delivery area, and at least one card may remain stationary within the buffer area until the card delivery area is sensed to be empty of cards. The method may be generated by a sensor in the card delivery area indicating that an additional card is desired in the card delivery area. The signal may be generated by a sensor in the card delivery area indicating that no cards are present in the card delivery area.

The above structures, materials and physical arrangements are exemplary and are not intended to be limiting. Angles and positions in the displayed designs and figures may be varied according to the design and skill of the artisan. Travel paths of the cards need not be precisely horizontal from the card input area to the delivery area of the shoe, but may be slightly angled upwardly, downwardly or varied across the path from the card input area to the card delivery area. The cards may be sensed and/or read within the shoe while they are moving or when they are still at a particular location within the shoe.

Figure 10:
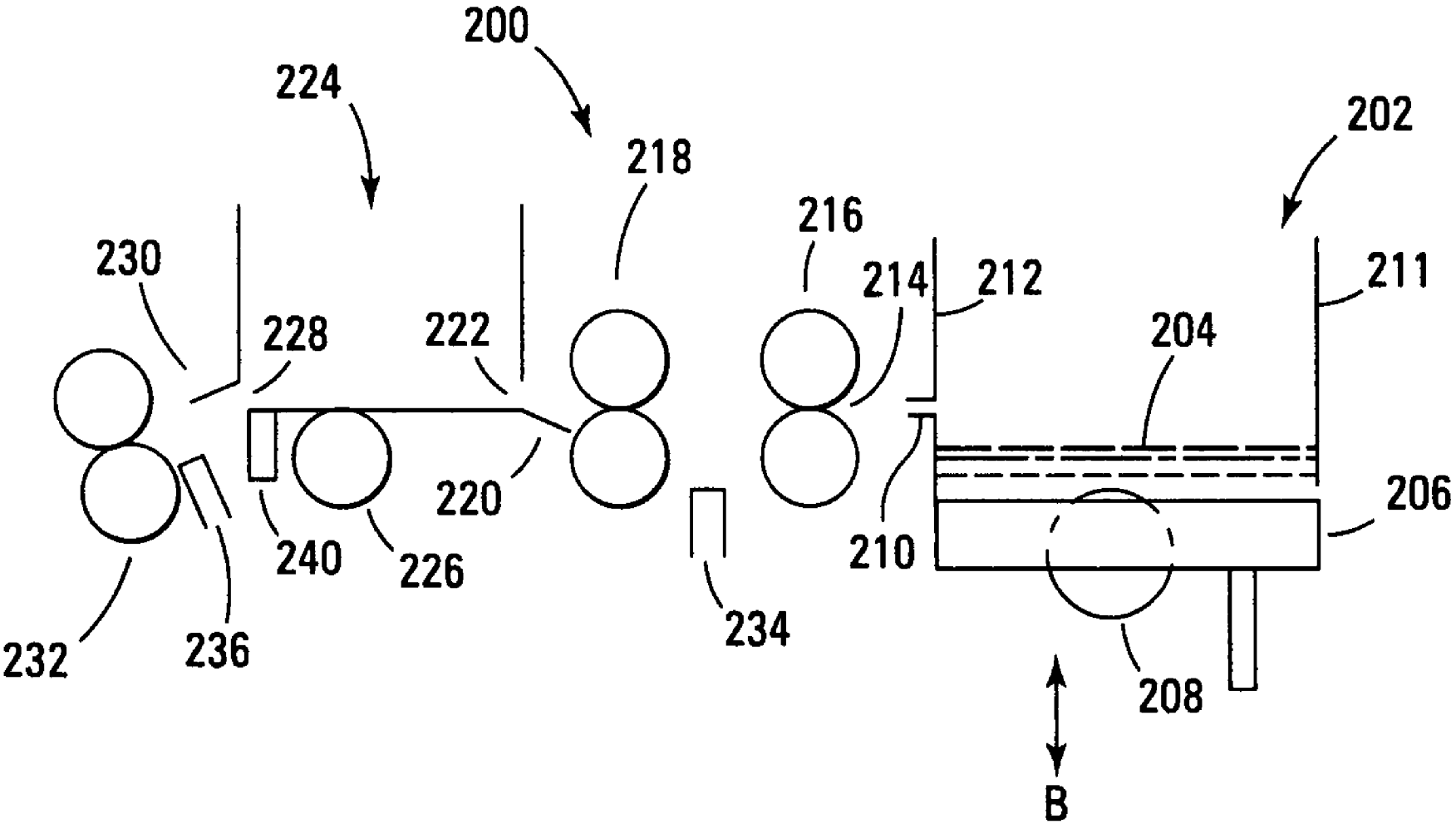
FIG. 10 shows a schematic cross-section of a dealing shoe having a card reading and buffer area.

FIG. 10 shows an alternate embodiment for internal card buffering and card moving elements of the card delivery shoe 200. A card infeed area 202 is provided for cards 204 that sit between walls 211 and 212 on elevator 206 which moves vertically along path B. A pick-off roller 208 drives cards one-at-a-time from the bottom of the stack of cards 204 through opening 210 that is spaced to allow only one card at a time to pass through the hole 210. When the card is aligned with opening 110, the individual card is fed into the nip area 214 of the first speed control or guide roller pair 216 and then into the second guide roller pair 218. The cards (one-at-a-time) passing through rollers 218 are shown to deflect against plate 220 so that cards flare up as they pass into opening 222 and will overlay any cards (not shown) in card buffer area 224. A second pick-off roller 226 is shown within the buffer area 224 to drive cards one-at-a-time through opening 228. The individual cards are again deflected by a plate 230 to pass into guide roller pair 232 that propels the cards into the delivery area (not shown) similar to the delivery area 136 in FIG. 9. Card reading elements may be positioned at any convenient point within the card delivery shoe 200 shown in FIG. 10, with card reading elements 234 and 236 shown as exemplary convenient locations.

Figure 11:
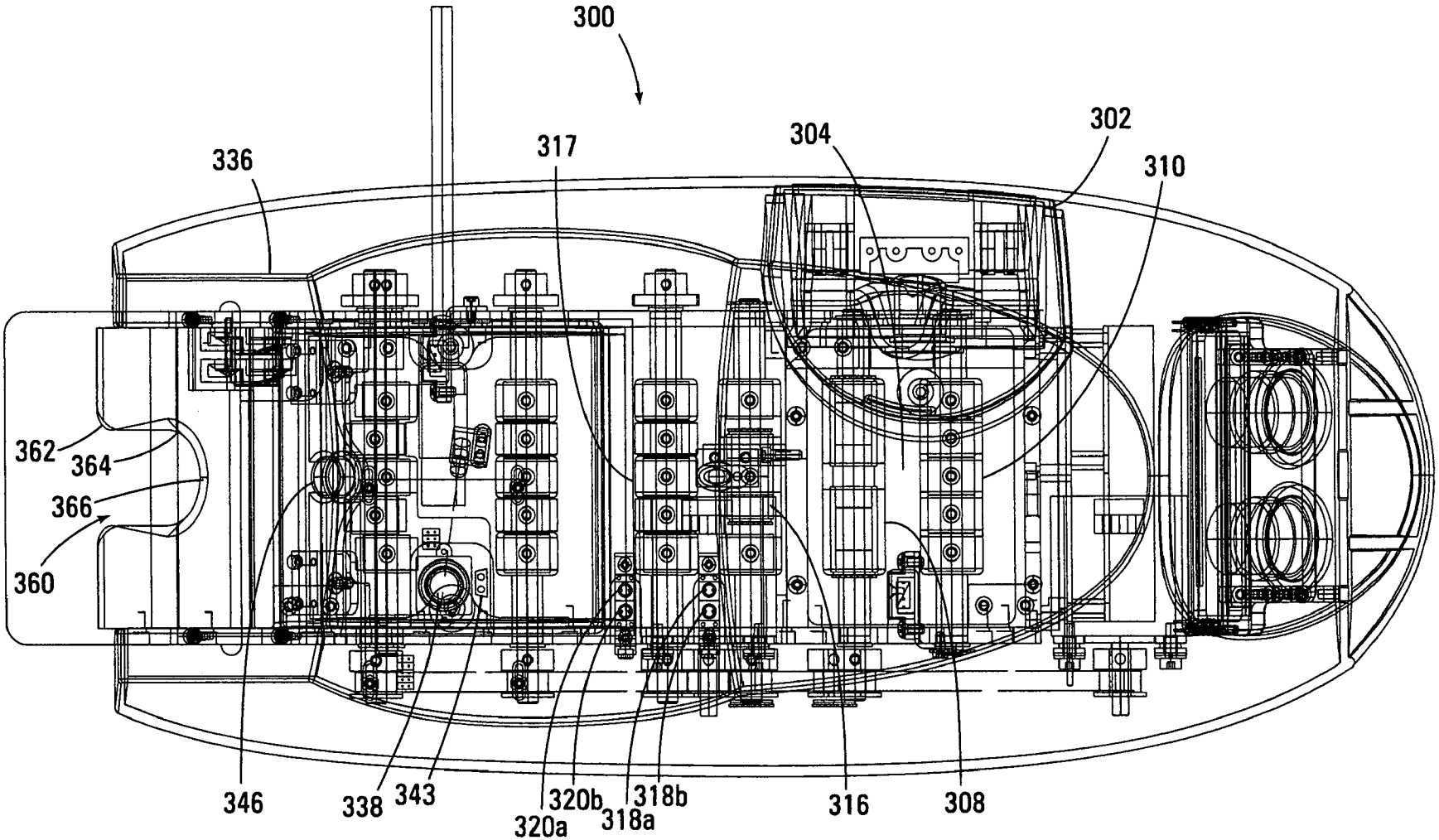
FIG. 11 shows a top cutaway view of one embodiment of a dealing shoe of FIG. 1 according to the present invention.

FIG. 11 shows a top view of a mechanized dealing shoe 300 of an embodiment of the present invention. A flip up door 302 allows cards to be manually inserted from above into the card input area 304. The sets of pick-off rollers 308 and 310 are shown in the card input area 304. The position of the sensors 318*a* and 318*b* and 320*a* and 320*b* are shown outwardly from the sets of five brake rollers 316 and five speed up rollers 317. The sensors are shown in sets of two sensors, which is an optional construction and single sensors may be used. The dual set of sensors (as in 320*a* and 320*b*) are provided with the outermost sensor 320*b* providing simply sensing card presence ability and the inner innermost sensor 320*a* reads the presence of card to trigger the operation of the camera card reading sensor 338 that reads at least value, and optionally rank, and suit of cards. The sensor 320*a* alternatively may be a single sensor used as a trigger to time the image sensing or card reading performed by CMOS/FPGA imaging system 338 as well as sensing the presence of a card. An LED light panel 343 or other light providing system is shown present as a clearly optional feature. Examples of suitable LED light sources include white light, blue light and most preferably green light. A sensor 346 at the card removal end 336 of the shoe 300 is provided. The finger slot 360 is shown at the card delivery area 336 of the shoe 300. The lowest portion 362 of the finger slot 360 is narrower then the top portion 364 of the finger slot. The walls 366 may also be sloped inwardly to the shoe and outwardly towards the opening 360 to provide an ergonomic feature to the finger slot 360.

Because the location/size of the card rank and suit is not the same from brand to brand of cards, the inventor devised a way to look for location of the rank and suit information by using column sums of selected indices of the signal, which can work even when different brands of cards with different symbol images are used, without the necessity of training the system or redesigning FPGAs to match specific symbols. This is a distinct advantage over most disclosed systems that require specially marked cards or training for each type of card used. Location of the rank/suit symbols is extracted from information about where the sums are low. This feature allows the sensed objects to be located in different areas in the larger sensing area and allows the device to successfully locate and compare the vectors.

Referring back to FIG. 1, this technique may be implemented by utilizing an optical position sensor 18 that resides on the CMOS module 10. The optical card presence sensor 18 may sense the presence of a card. The sensor may be positioned at a specific location of the device where it can detect the card presence. The sensor outputs data when it senses a card. It communicates with the FPGA 14 via a digital input/output port. A second sensor 28 senses when the same card is removed.

The CMOS array 12 may reside on the CMOS module 10. The output voltage of the CMOS array is an indication of a shade of gray measured on each pixel of the array, since the system is a black and white reading system. Color scanning may be used, is not needed for collecting the desired signals for determining suit and rank. In a black and white system, the output of the CMOS array is converted into binary code in the sensor, in a separate hardware element or in the FPGA and the output would then be a series of numerical values equal to 1 or zero. Any scanned shade of gray is initially represented by a digital signal between 0 and 255 and is then converted to a 1 or a 0.

Figure 12:
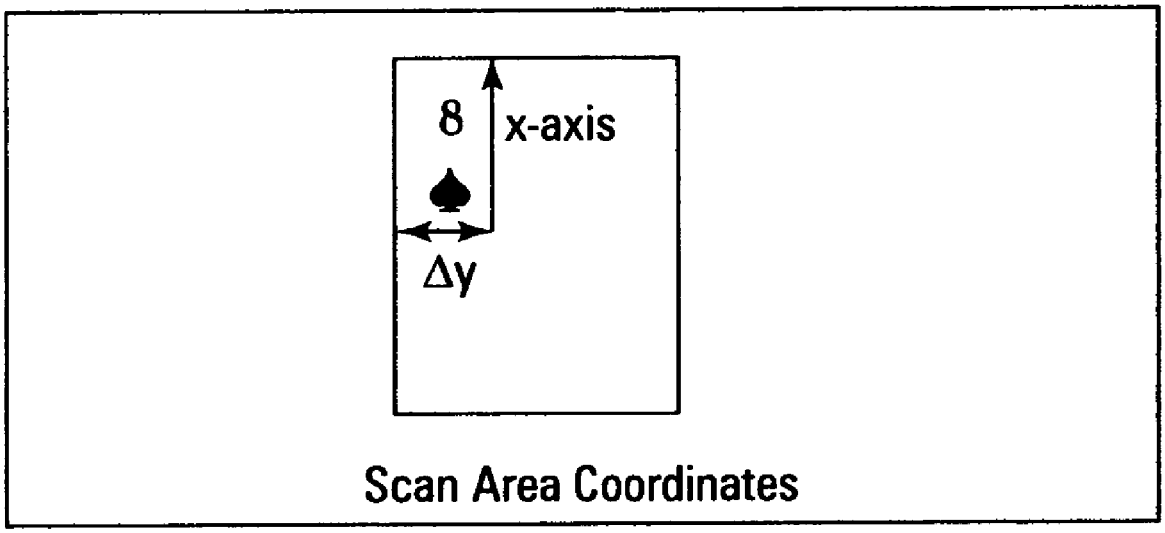
FIG. 12 shows selected coordinates in a CMOS scanning field.

One proposed system scans the entire area of the card face containing the rank and suit symbols one pixel at a time. The area is defined by coordinates X and Y. The CMOS array 12 and the optical position sensor 18 read the x and the y directions accordingly. FIG. 12 shows the coordinates of the area.

To determine card rank and suit, the system must first be trained or hardwired to recognize card rank and suit. To accomplish this, a single vector set for each rank (A, K, Q, J, 10, 9, 8, 7, 6, 5, 4, 3, 2) and a vector set for each suit (Hearts, Clubs, Diamonds and Spades) is scanned, converted to binary values and is saved (e.g., a known reference vector set is saved for each distinct symbol) by acquiring a set of signals during a training phase, or by hardwiring the system based upon a known set of card symbols or using a large tolerance hardwiring for a range of symbols. The signals acquired during training undergo the same binary conversion and are stored.

During the identification process, an unknown vector set is acquired when a triggering signal is detected. This unknown vector set, as indicated above, may preferably be the single set of gray scale values, a set of binary values from the individual pixel scans, or be a combination of at least two attributes. The triggering signal can take many forms. The triggering mechanism can be an edge sensor (indicating that a first leading edge of a playing card has passed over an optical or motion sensor, a motion sensor indicating movement of a playing card, an optical present sensor 18 (shown in FIG. 1) indicating the presence of optical density other than white (e.g., a card sensor) over an optical sensor, or the like. Upon triggering of the CMOS sensor 12, the scanning may be continuous or may continue on a timed, or sensed (e.g., distance or speed of movement of the card, degree of variation in the signal from the sensor, etc.) basis. To account for any motion of the card, a fast exposure time is used such as 1/1000 of a second or less.

When automated movement is provided, as with the mechanized shoe shown in FIG. 9, by automatically feeding individual cards into the dealer recovery position, timed triggering may be more appropriate. The unknown vector is then correlated with the known vectors to determine a match and identify the card's rank and suit.

As mentioned earlier, cross correlation of 2D signals A and B may be defined as following equation, where 'A' is the unknown signal and 'B' is the template signal.

$$\frac{\sum\sum A*B}{\sqrt{\sum\sum A*A*\sum\sum B*B}} \tag{1}$$

For a binary signal as constrained as described, the correlation reduces to a simple binary AND operation and summation of the result over the entire vector. Then in template matching, it can be shown mathematically that for the 2D case of shifting the template over a 2D matrix, this concept can be transferred to a 1 D vector by shifting the order of the vector.

To match the card, a series of 'Correlators' is generated in the FPGA that correlates all ranks and suits with the unknown vector either sequentially, or preferably concurrently. The unknown vector is then shifted and a new series of correlations performed. (The term "shifted" means that the top two values of the series of values that constitutes the entire vector (each being a zero or a 1) is removed from the top of the vector and placed at the bottom of the vector, changing the order of the number pairs in the vector. For example, a simple vector might be the following order pairs:

0,0
0,1
1,1
1,1
1,0
1,0
0,0
0,1

By shifting the top pair to the bottom, the vector becomes:

0,1
1,1
1,1
1,0
1,0
0,0
0,1
0,0

This process is continued over a wide range of shifts. The results of the correlations are saved, compared and the maximum correlation value (with respect to the known vectors) is used to identify rank and suit.

Figure 13:
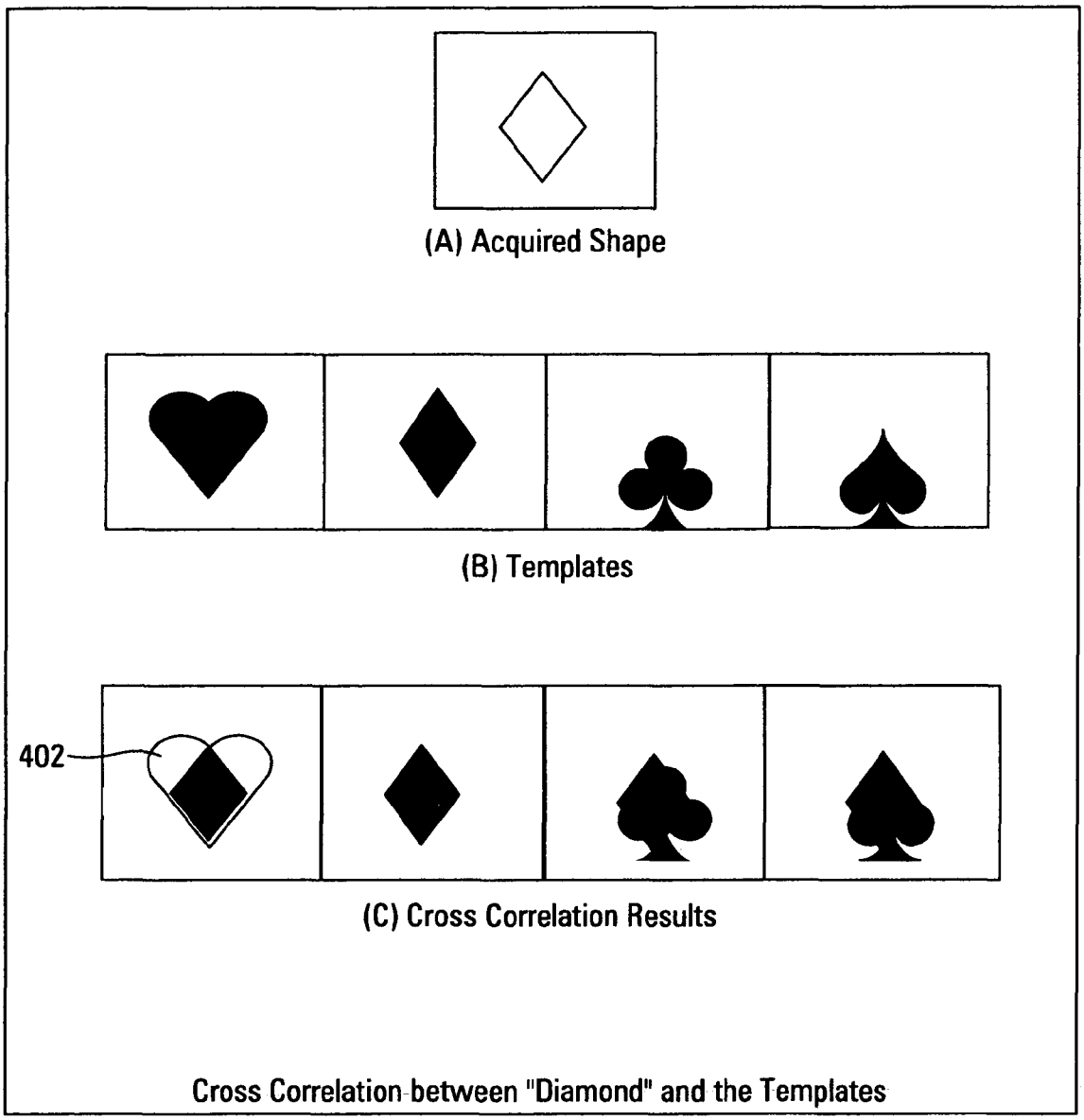
FIG. 13 shows a series of stored images and a cross correlation outcome of different suits.

As shown in FIG. 13, the inventor originally encountered a problem in correctly identifying the suit of the cards using the cross correlation technique: a "diamond" is read as the "heart". This is because the diamond shape can be fit into the heart shape, see FIG. 13C for illustration. As a result, the diamond shape could have been reported as both heart or a diamond by the FPGA Card Identification Module. To avoid this type of misread, the inventor uses the error correction function to compares the "un-matched" area 402 of the shapes. The error correction function is defined as the following equation:

$$\Sigma\Sigma A*B-\Sigma\Sigma A'*B \quad (2)$$

By using the technique, the device is able to detect the unmatched area 402 and, therefore deduces the correct shape.

The proposed device is preferably implemented using FPGA technology (rather than using a an external processor and memory) to improve the speed of identifying cards and to dramatically reduce the cost. Speed is improved because operations are performed in real time with hardware logic circuits, rather than software running on a processor. Costs are reduced because there is no longer any need for complex computational capability. Following a card identification cycle, the card ID data can be stored locally by a database storage system, the processor and/or transmitted to a remote location for storage.

The term camera as generally used herein is intended to have its broadest meaning to include any component that accepts radiation (including visible radiation, infrared, ultraviolet, etc.) and provides a signal based on variations of the radiation received. This can be an analog camera or a digital camera with a decoder or receiver that converts the received radiation into signals that can be analyzed with respect to image content. The signals may reflect either color or black-and-white information or merely measure shifts in color density and pattern. Area detectors, semiconductor converters, optical fiber transmitters to sensors or the like may be used. Any convenient software may be used that can convert to radiation signals to information that can identify the suit/rank of a card from the received signal.

The term "camera" is not intended to be limited in the underlying nature of its function. Lenses may or may not be needed to focus light, mirrors may or may not be needed to direct light and additional radiation emitters (lights, bulbs, etc.) may or may not be needed to assure sufficient radiation intensity for imaging by the camera.

There are a number of independent and/or alternative characteristics of the delivery shoe that are believed to be unique in a device that does not shuffle, sort, order or randomize playing cards.

1) Pre-shuffled cards are inserted into the shoe for dealing and are mechanically moved through the shoe but not necessarily mechanically removed from the shoe.
2) The shoe may optionally mechanically feed the cards (one at a time) to a buffer area where one, two or more cards may be stored after removal from a card input area (before or after reading of the cards) and before delivery to a dealer accessible opening from which cards may be manually removed.
3) An intermediate number of cards are positioned in a buffer zone between the input area and the removal area to increase the overall speed of card feeding with rank and/or suit reading and/or scanning to the dealer.
4) Sensors indicate when the dealer accessible card delivery area is empty and cards are automatically fed from the buffer zone (and read then or earlier) one-at-a-time.
5) Cards are fed into the dealer shoe as a vertical stack of face-down cards, mechanically transmitted approximately horizontally, read, and driven into a delivery area where cards can be manually removed.
6) Sensors detect when a card has been moved into a card reading area. Signal sensors can be used to activate the card reading components (e.g., the camera and even associated lights) so that the normal symbols on the card can be accurately read.

With regard to triggering of a camera or imager, a triggering mechanism can be used to set of the camera shot at an appropriate time when the card face is expected to be in the camera focal area or image plane or location. Such triggers can include one or more of the following, such as optical position sensors within an initial card set receiving area, an optical sensor, a nip pressure sensor (not specifically shown, but which could be within either nip roller (e.g., 116 or 117, see FIG. 9), edge sensor, light cover sensor, and the like. When one of these triggers is activated, the camera is instructed to time its shot to the time when the symbol containing corner of the card is expected to be positioned within the camera focal area. The card may be moving at this time and does not have to be stopped. The underlying function is to have some triggering in the device that will indicate with a sufficient degree of certainty when the symbol portion of a moving or moved card will be with the camera focal area. A light associated with the camera may also be triggered in tandem with the camera or imager so as to extend the life of the light and reduce energy expenditure in the system.

CMOS/FPGA Card Reader as Part of a Simple Shoe

The proposed card delivery device that utilizes the card identification method described above in an alternate embodiment is a manual card delivery shoe (not shown). The card delivery device can deliver single or multiple decks of cards. This is different from the mechanized Shoe as shown in FIGS. 9 and 11 as this shoe does not necessarily have a motor and other mechanical elements and the reading and correlation system is improved there from. The imaging system is arranged so that cards being removed from the shoe are read by a CMOS imaging system of the present invention.

One preferred embodiment of the delivery shoe, its methods and apparatus may be generally defined as card delivery shoe having a storage end and a delivery end. The shoe stores a first set of pre-shuffled cards in the storage end and allows manual removal of cards from the delivery end. The lower edges of the cards rest on a declining surface, whose lowermost edge is at the delivery end of the shoe. A block or stop slides along the declining surface, and is positioned nearest the storage end, holding the cards against the delivery end. The delivery end may optionally be equipped with a motor driven shaft bearing a feed wheel (not shown), which moves a card out of the shoe. A sensor may provide a signal (to some intelligence or signal receiving function) and power is provided to a motor so that a next card is delivered to the delivery end. The card can be manually or automatically removed. The card delivery shoe may also have at least one sensor that reads card values in the card delivery shoe as each card is removed from the shoe. A preferred sensor is the CMOS/FGPA sensor and control logic of the present invention.

Baccarat Game Control System with Simple Shoe

Baccarat is one of the many live table games played in casinos or gaming establishments. Baccarat uses a standard deck of 52 playing cards and is usually dealt from a shoe having multiple decks that have been shuffled together prior to the beginning of play. Poker is usually dealt from a single deck of cards, and blackjack (Twenty-One) is dealt from at least one deck, with up to eight or more decks in a shoe being in common use.

One set of individual and/or collective primary purposes of the reading suit and or rank of cards in the dealing shoe is to enable:

1) The shoe to read the cards, either as being dealt (as they leave the shoe) and/or as they are fed into the dealing chamber of the shoe.
2) Based on fixed rules of Baccarat, which are simple and readily treated by algorithms and mathematic formulas, Wins/Losses on each round of play can be determined.
3) The information (rank) relating to the cards read by the dealing shoe is provided to a processor and the value of each hand is determined.
4) The Win/Loss information can be used to display the winning results on a board and to determine Wins/Losses.
5) The data from the dealing shoe can transferred and processed in real time or transferred and analyzed or processed at a later date.

The dealing shoe for use with the casino table card games may be integrated with other components, subcomponents and systems that exist on casino tables for use with casino table games and card games. Such elements as bet sensors, progressive jackpot meters, play analysis systems, wagering analysis systems, player comping systems, player movement analysis systems, security systems, and the like may be provided in combination with the baccarat shoe and system described herein. Newer formats for providing the electronics and components may be combined with the baccarat system. For example, new electronic systems used on tables that provide localized intelligence to enable local components to function without absolute command by a central computer are desirable.

Figure 14:
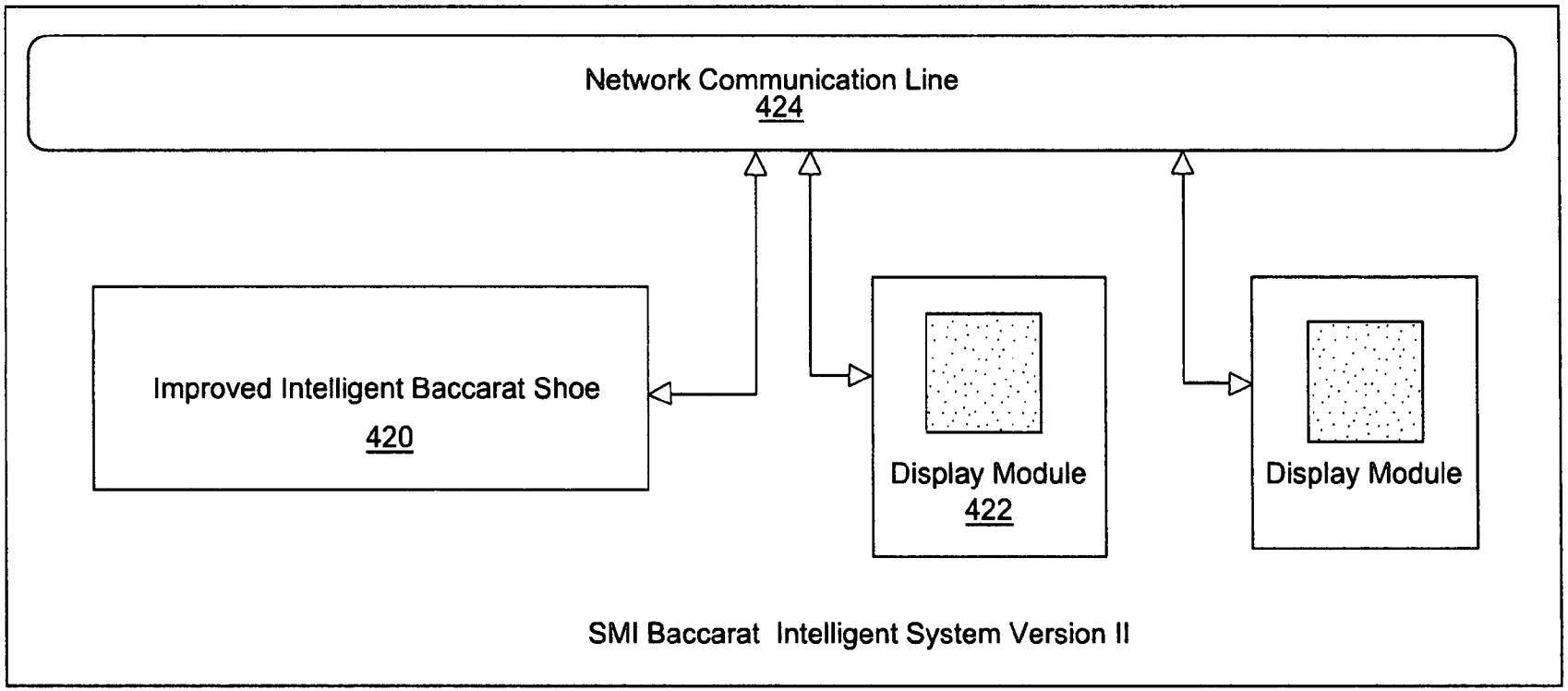
FIG. 14 shows a block diagram of a Baccarat Intelligent System which uses a mechanized shoe with CMOS reading capability.

The improved Baccarat Intelligent System described herein and shown in FIG. 14 may include one card delivery device (preferably a simple shoe) 420 with CMOS sensing, and an internal FPGA logic module and an optional Reader Board/Display Module 422. The individual modules are connected to a network communication line 424, and do not communicate directly to other modules.

As illustrated in FIG. 14, the baccarat shoe 420 is in two-way communication via standard network communication line 424, and through this connection, data generated by the shoe 420 is sent to a remote database (not shown) via a network communication line 424. The display module 422 is also in two-way communication with the network. It is programmed to display cumulative card rank information for each hand (banker and player) that was transmitted by the baccarat shoe, and other game-related information such as win/loss hits taken, historical win/loss/tie information side bet outcomes and the like.

Figure 15:
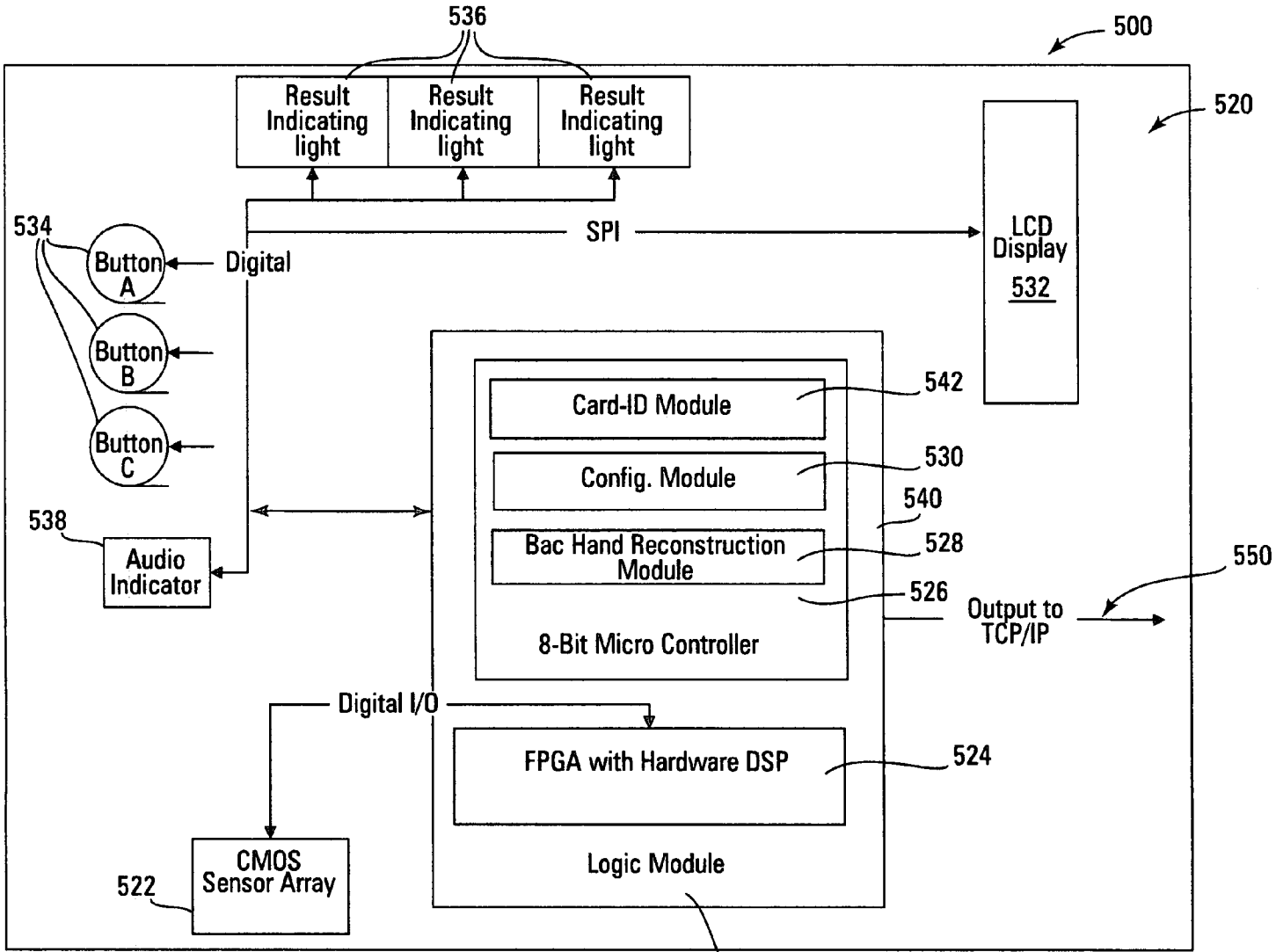
FIG. 15 shows a schematic diagram of a second Baccarat System using CMOS sensing and a non-mechanized shoe.

An improved card delivery device of the present system is an 8-deck simple card delivery shoe (not shown). The shoe lacks mechanical card-moving mechanisms. A diagrammatical illustration of the delivery shoe 500 is shown in FIG. 15. The simple shoe 500 contains the following internal hardware components: CMOS sensor array 522, a plurality of result indicating lights 536 and buttons 534, an audio indicator 538, one logic module 540, and a LCD display 532. The logic module 540 includes a field programmable gated array 524, and one 8-bit microcontroller 526. The microcontroller includes a baccarat hand reconstruction module 528, a configuration module 530 and a card identification module 542.

The CMOS sensor array 522 is located near the exit end of the shoe. The FPGA 524 and the 8-bit microcontroller 526 reside on the logic module 540. This logic module 540 replaces the external mini computer needed when a conventional camera is used for card identification and also acts as a game controller and communication channel. The CMOS sensor array 522 is connected directly to the FPGA 524. The sensor array 522 generates an output signal that corresponds to gray scale values detected on the card.

A card passing through the exit end of the shoe triggers the FPGA to read the output of CMOS sensor array 522. The FPGA is configured to act as a digital signal processor, which transforms the signal into a signal representing card rank and or suit.

The 8-bit microcontroller 526 acts as a system controller and communication channel. It contains three software modules: Card Identification module 542, the Baccarat Hand Reconstruction module 528 and the Configuration module 530. The Card-ID module reads the output of the FPGA, compares the signals to stored signals and determines rank and suit. The module also transmits or saves it as appropriate per the configuration.

The Baccarat Hand Reconstruction module has the capabilities of reconstructing the hands and determining the outcome of each round, according to the rules of Baccarat. The device can be programmed with other game rules to track the play of other games. The hand information is sent out from the logic module as the shoe output via the network communication port.

The Configuration module 530 in one example of the invention has an imbedded web server which gives the user the capability to remotely change the configuration of the Baccarat Hand Reconstruction module, as well as options for the shoe through a web interface and store that information in flash memory of the 8-bit microcontroller.

The logic module 528 controls the buttons 534, result indicating lights 536, LCD display 532, the audio indicator 538, The LCD display 532 is located on the back of the shoe. It displays messages to communicate with users (dealers), helping user to operate the delivery shoe. For example, the display indicates when the dealer must deliver a hit card to a baccarat hand.

There are at least a total of three signal control buttons 534 on the shoe. One of them is located on the front side of the shoe, and the other two are located on the back of the shoe above the LCD. These three buttons are also used as switches. When a light button is pressed, the logic module issues a command. For instance, the game information will not be displayed until Button A is been pressed, therefore, the dealer can decide the best time to display game result; Button B can be used to set up mode when power up the system; Button C can be used for service mode when powering up the system. The functions of these buttons are customizable, which means they can be programmed differently to meet customer's varied requests.

The three result indication lights 536 are located on top of the shoe. A message is sent from the Baccarat hand reconstruction module to the 8-Bit Micro Controller. The 8-Bit microcontroller triggers the lights to come on/off. The light indication feature allows users (casinos) to select different colors when configuring the shoe) to indicate Banker, Player and Tie. The typical available colors are: red, blue, green, yellow and orange.

The audio indicator 538 is also an optional feature. It can be configured to alarm operational errors or shoe malfunctions. The events that trigger the alarm are customizable through the user interface of the device. The events include but are not limited to the following:

Door Open;

End of Round Missing (when dealer does not push a button to indicate "end of round" before pulling out the next card);

Extra End of Round (when dealer pushes the button to indicate "end of round" before the round is over);

While burning cards;

Dealing start (after burning cards);

After cut card has been reached and dealer is still dealing cards.

The display or "reader board" may be selected from available components. The reader board contains a processor that is capable of communicating with the network. This non-limiting description is for the ITS module that functions as a game result displaying device. Instead of depending on manual input, this automatic reader board 422 (shown in FIG. 14) receives data directly from the network communication line 424. The messages from the intelligent shoe 420 may be broadcasted to the network. The display module can be programmed to "listen" and react to the state changes of the shoe, and display the outcome of the game automatically. Alternatively, a networked-based controller can also send display commands to the display module 422.

Even though it is possible to display the game results in real time, to maintain excitement, the game outcomes are preferably displayed with a time delay or triggered by the dealer pushing a button. The amount of the delay time is variable upon the user's requests. In addition to current game results, historical game results can also be displayed, as well as messages, advertising and the like.

Figure 16:
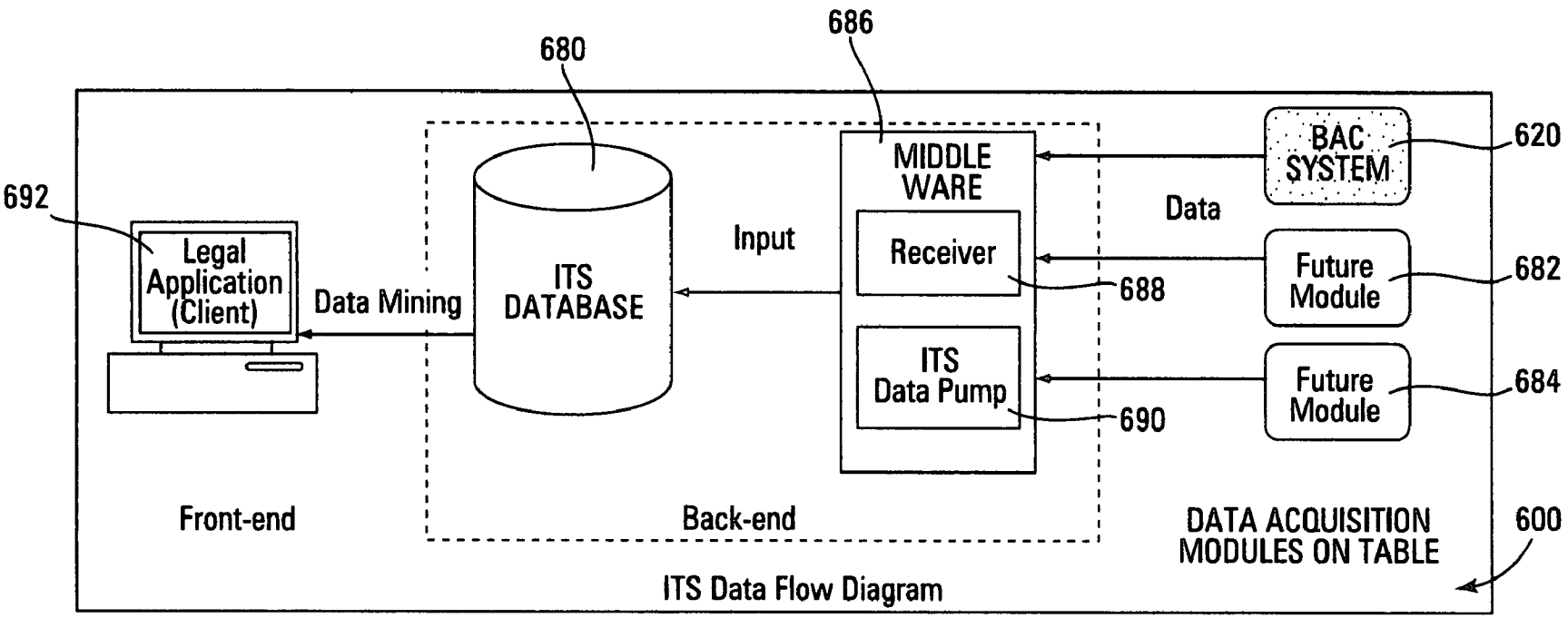
FIG. 16 shows a schematic of how data acquired by a Baccarat System using CMOS sensing is collected and accessed.

As shown in FIG. 16, the baccarat system 620 can be used as a data acquisition component of a module of a larger casino data acquisition system 600. The collected data can be used to perform casino table game analysis. Data analysis is possible when multiple data acquisition modules are in communication with a database 680, preferably on a network, and the information is stored in the database 680. Other data acquisition modules 682, 684 can be connected to the network and data can be transferred to the database 680 via a middleware receiver 686. The middleware receiver 686 includes a data receiver 688 and a data pump 690.

Data can be accessed and mined via a local "thin client" application that allows users to view game results remotely on a web enabled devices such as desk top computer, PDA, Black Berry etc. 692.

What is claimed:

1. A card reading apparatus for the determination of at least one of rank or suit of a playing card comprising:

at least one two-dimensional complementary metal oxide semiconductor imaging system capable of producing a signal in response to reading a card;

the imaging system being located within the card reading apparatus where a face of a playing card is readable by the imaging system; and, a hardware component that receives the signal produced by the imaging system reading the face of the playing card, wherein the hardware component identifies at least one of rank and suit from the signal and transmits data indicating the at least one of rank or suit to an external data storage device.

2. The apparatus of claim 1 wherein the hardware component comprises a FPGA logic circuit or an ASIC.

3. An apparatus for reading symbols from playing cards comprising an imager that images an area on the face of the playing cards containing rank and or suit markings on the playing cards in at least the region where suit and rank symbols are provided on the playing cards, wherein gray scale data is generated and transformed into binary data, and the binary data is further processed into data representing at least one of a suit or rank of the playing card.

4. The apparatus of claim 3 wherein the gray scale data comprises an integer within the range of gray scale resolution of the imager.

5. The apparatus of claim 3 wherein the imager comprises a CMOS sensing system.

6. The apparatus of claim 3 wherein the signal is provided to an FPGA or ASIC to identify the at least one of a suit or rank of the playing card imaged which then transmits the data indicating the at least one of rank or suit to an external data storage device.

7. The apparatus of claim 3 wherein the signal is correlated with known signals to identify the at least one of a suit or rank of the playing card imaged.

8. An apparatus for reading symbols from playing cards comprising a CMOS sensing system having at least one CMOS sensing array, and a card present sensor, the card present sensor triggering data collection from the at least one CMOS sensing array to provide signals from reading playing card symbols on the face of playing cards where visible symbols of suit and rank are present when the cards are passed over the at least one CMOS sensing array.

9. A method for identifying suit and rank on playing cards comprising:

passing symbols on a face of a playing card where visible symbols of suit and rank are present over a two-dimensional complementary metal oxide semiconductor imager to from data of an image, parsing the data of the image into rank area and suit areas, providing signals of the parsed data from the imager to a hardware component, and the hardware component identifying suit and rank of the playing card from the signals.

10. A method for identifying suit and rank on playing cards comprising:

passing symbols on a face of a playing card where visible symbols of suit and rank are present over a two-dimensional complementary metal oxide semiconductor imager to form data of an image, parsing the data of the image into rank area and suit areas, providing signals of the parsed data of the image from the imager to a hardware component, and the hardware component identifying suit and rank of the playing card from the signals, wherein identifying suit and rank based upon the signals comprises providing signals indicative of gray scale values within a range of gray scale values.

11. A method for identifying suit and rank on playing cards comprising:

passing symbols on a playing card over a two-dimensional complementary metal oxide semiconductor imager, parsing the image into rank area and suit areas, providing signals from the imager to a hardware component, and the hardware component identifying suit and rank of the playing card from the signals, wherein identifying suit and rank based upon the signals comprises providing signals indicative of gray scale values within a range of gray scale values wherein the signal indicative of one gray scale value is converted to a binary value.

12. The method of claim 11 wherein said binary values comprises a template and the cross correlation values of two independent matrices are compared where the cross correlation of two matrices A and B is defined as:

$$\frac{\sum\sum A*B}{\sqrt{\sum\sum A*A*-\sum\sum B*B}}.$$

13. The method of claim 12 wherein the correlation is executed in a field programmable gated array.

14. The method of claim 13 wherein information of at least one of suit and rank from the field programmable gated array is stored in a database.

15. The method of claim 14 wherein information stored in said database is mined by a processor.

16. The method of claim 13 wherein information of at least one of suit and rank from the field programmable gated array is stored in a processor memory.

17. A method for identifying suit and rank on playing cards comprising:

passing symbols on a playing card over a two-dimensional complementary metal oxide semiconductor imager, parsing the image into rank area and suit areas, providing signals from the imager to a hardware component, and the hardware component identifying suit and rank of the playing card from the signals, wherein identifying suit and rank based upon the signals comprises providing signals indicative of gray scale values within a range of gray scale values wherein an error correction function is applied to templates of at least one of rank and suit images and the error correction function is defined as the following equation:

$$\Sigma\Sigma A^{*}B-\Sigma\Sigma A'^{*}B$$

to detect unmatched areas between signals from the imager and predetermined signals.

18. The method of claim 17 wherein after determination of suit and/or rank, the determination is sent to a game control processor for evaluation of game results.

19. A playing card delivery shoe for use in the play of the casino table card game of at least one of baccarat or blackjack from which delivery shoe cards may be dealt comprising:

a) an area for receiving a first set of playing cards useful in the play of the casino table card game of at least one of blackjack or baccarat;

b) first card mover that moves playing cards from the first set to a playing card staging area wherein at least one playing card is staged in an order by which playing cards are removed from the first set of and moved to the playing card staging area;

c) second playing card mover that moves playing cards from the playing card staging area to a delivery area wherein playing cards removed from the staging area to the delivery shoe are moved in the same order by which playing cards were removed from the first set of playing cards and moved to the playing card staging area; and d) a playing card reading sensor that reads at least one playing card value of each playing card separately, the playing card reading sensor comprising a CMOS sensor and FPGA logic circuit;

wherein there is a communication link between the playing card reading sensors and the FPGA logic circuit, wherein the FPGA logic circuit determines rank and suit of cards.

20. The apparatus of claim 19, and further comprising a processor which analyzes said data according to rules of play of the game of at least one of blackjack or baccarat and determines results of play for a round of play based upon said data.

21. A dealing shoe capable of reading cards, comprising:

a cavity for receiving a group of shuffled cards, a lower surface of the cavity, a front end and a back end, wherein the lower surface declines towards the front end where cards are removed;

a weighted wedge that contacts a surface of a card nearest the back end and rests on the declining lower surface, urging cards towards the front end;

a card removal opening in the front end;

a card reading sensor proximate the front end, the sensor comprising a CMOS sensing array and a FPGA control logic for receiving signals from the CMOS sensing array and determining rank and suit of each sensed card.

22. An automatic card shuffler comprising a sensor for reading at least one of a rank and suit of cards from a face of a playing card having visible symbols of suit and rank thereon, comprising:

a housing;

a card input tray;

a shuffling mechanism;

a card output tray, and a card sensor within the housing comprising a CMOS sensor and FPGA control logic, the FPGA control logic adapted to receive signals from the CMOS sensor when a face of a playing card having visible symbols of suit and rank is read and the FPGA control logic determines rank and suit from the sensed signals from the face of the playing card.

* * * * *